US009615626B2

(12) United States Patent
Rushbrook

(10) Patent No.: US 9,615,626 B2
(45) Date of Patent: Apr. 11, 2017

(54) SOLE STRUCTURE WITH SEGMENTED PORTIONS

(71) Applicant: Nike, Inc., Beaverton, OR (US)

(72) Inventor: Thomas J. Rushbrook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 135 days.

(21) Appl. No.: 14/135,609

(22) Filed: Dec. 20, 2013

(65) Prior Publication Data

US 2015/0173456 A1 Jun. 25, 2015

(51) Int. Cl.
*A43B 13/14* (2006.01)
*A43B 5/00* (2006.01)

(52) U.S. Cl.
CPC ..... *A43B 13/141* (2013.01); *A43B 5/001* (2013.01)

(58) Field of Classification Search
CPC ..... A43B 13/14; A43B 13/12; A43B 13/141; A43B 13/16; A43B 5/001
USPC .. 36/25 R, 28, 30 R, 30 A, 31, 92, 102, 103, 36/107, 127, 27, 37
See application file for complete search history.

(56) References Cited

U.S. PATENT DOCUMENTS

| | | | | |
|---|---|---|---|---|
| 2,370,963 | A | 3/1945 | Issaly | |
| 4,059,910 | A | 11/1977 | Bryden et al. | |
| 6,079,126 | A | 6/2000 | Olszewski | |
| 6,119,373 | A | 9/2000 | Gebhard et al. | |
| 7,634,861 | B2 | 12/2009 | Kilgore | |
| 7,647,709 | B2 * | 1/2010 | Reilly | A43B 7/142 36/107 |
| 2005/0150134 | A1 * | 7/2005 | Issler | A43B 13/16 36/102 |
| 2008/0022562 | A1 | 1/2008 | Manis | |
| 2009/0249653 | A1 | 10/2009 | Gunthel et al. | |
| 2012/0167416 | A1 * | 7/2012 | Christensen | A43B 3/0057 36/103 |
| 2012/0174432 | A1 * | 7/2012 | Peyton | A43B 13/125 36/28 |
| 2012/0204449 | A1 | 8/2012 | Stockbridge et al. | |

FOREIGN PATENT DOCUMENTS

JP 8000306 A 1/1996

* cited by examiner

*Primary Examiner* — Anna Kinsaul
*Assistant Examiner* — Heather Mangine
(74) *Attorney, Agent, or Firm* — Quinn Law Group, PLLC

(57) ABSTRACT

A sole structure for an article of footwear includes an upper layer comprised of a plate member and a lower layer comprised of a plurality of segmented portions separated by flexing regions. The flexing regions may comprise portions of a compressible material. The sole structure accommodates vertical bending and torsion, while limiting lateral bending.

15 Claims, 18 Drawing Sheets

SOLE STRUCTURE WITH SEGMENTED PORTIONS

BACKGROUND

The present embodiments relate generally to sole structures for articles of footwear.

Athletic shoes have two major components, an upper that provides the enclosure for receiving the foot, and a sole secured to the upper. The upper may be adjustable using laces, hook-and-loop fasteners or other devices to secure the shoe properly to the foot. The sole has the primary contact with the playing surface. The sole may be designed to absorb the shock as the shoe contacts the ground or other surfaces. The upper may be designed to provide the appropriate type of protection to the foot and to maximize the wearer's comfort.

SUMMARY

In one aspect, a sole structure for an article of footwear includes a plate member and a plurality of segmented portions attached to a surface of the plate member, where the plurality of segmented portions are configured to contact a ground surface. The sole structure includes a central flexing region extending from a forefoot portion of the sole structure to a heel portion of the sole structure, where the central flexing region separates the plurality of segmented portions into a first set of segmented portions and a second set of segmented portions. The first set of segmented portions are associated with a first side of the sole structure and the second set of segmented portions are associated with a second side of the sole structure. The plurality of segmented portions are further separated by a plurality of outwardly extending flexing regions, where the plurality of outwardly extending flexing regions extend from the central flexing region to side edges of the sole structure. The central flexing region has a non-linear geometry.

In another aspect, a sole structure for an article of footwear includes a plate member including a first side and a second side and a plurality of segmented portions attached to the second side of the plate member, where the plurality of segmented portions are configured to contact a ground surface. The sole structure includes a central flexing region extending from a forefoot portion of the sole structure to a heel portion of the sole structure, where the central flexing region separates the plurality of segmented portions into a first set of segmented portions and a second set of segmented portions. The first set of segmented portions are associated with a first side of the sole structure and the second set of segmented portions are associated with a second side of the sole structure. The plurality of segmented portions are further separated by a plurality of outwardly extending flexing regions, where the plurality of outwardly extending flexing regions extend from the central flexing region to side edges of the sole structure. The plate member includes a plurality of side sections extending from an outer periphery of the plate member, the plurality of side sections presenting a sidewall portion.

In another aspect, a sole structure for an article of footwear includes a plate member including a first side and a second side and a plurality of segmented portions attached to the second side of the plate member, where the plurality of segmented portions are configured to contact a ground surface. The plurality of segmented portions further include a first set of segmented portions associated with a first side of the sole structure and a second set of segmented portions associated with a second side of the sole structure. The first set of segmented portions are spaced apart in the longitudinal direction and the second set of segmented portions are spaced apart in the longitudinal direction. The first set of segmented portions are separated from the second set of segmented portions in the lateral direction by a central longitudinal portion. The plurality of segmented portions comprise a lower layer of the sole structure and the plate member comprises an upper layer of the sole structure. A maximum cross-sectional thickness of the upper layer is less than a minimum cross-sectional thickness of the lower layer.

In another aspect, a sole structure for an article of footwear includes a plate portion including a first side and a second side and a plurality of lower segmented portions extending away from the second side of the plate portion, where the plurality of lower segmented portions are configured to contact a ground surface. The plurality of lower segmented portions further include a first set of lower segmented portions associated with a first side of the sole structure and a second set of lower segmented portions associated with a second side of the sole structure. The first set of lower segmented portions are spaced apart in the longitudinal direction and the second set of lower segmented portions are spaced apart in the longitudinal direction. The first set of lower segmented portions are separated from the second set of lower segmented portions in the lateral direction by a central flexing region, the central flexing region being a gap, and at least one lower segmented portion of the plurality of lower segmented portions includes a bottom portion that is a cantilevered portion.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

FIG. 16 is a schematic view of the sole structure of FIG. 13 bending in the vertical direction during the golfer's follow through;

DETAILED DESCRIPTION

Figure 1:
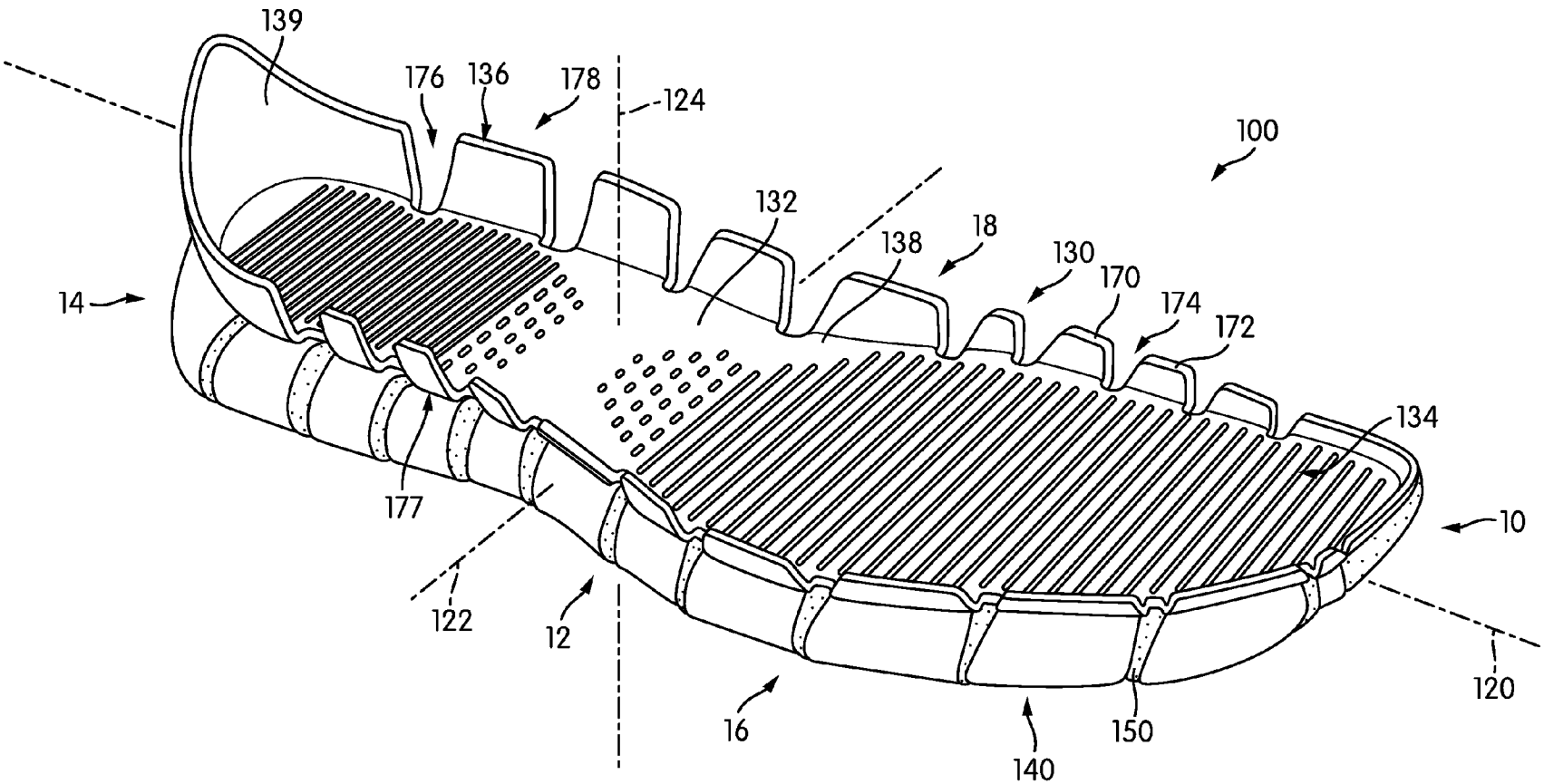
FIG. 1 is a schematic isometric view of an embodiment of a sole structure for an article of footwear.

FIG. 1 is illustrates a schematic isometric view of an embodiment of a sole structure 100 that may be integrated into an article of footwear. Sole structure 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments sole structure 100 may be configured for use with various kinds of non-sports related footwear, including, but not limited to: slippers, sandals, high heeled footwear, loafers as well as any other kinds of footwear.

Referring to FIG. 1, for purposes of reference, sole structure 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of sole structure 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of sole structure 100. Likewise, lateral side 16 and medial side 18 are intended to represent generally two sides of sole structure 100, rather than precisely demarcating sole structure 100 into two halves.

For consistency and convenience, directional adjectives are employed throughout this detailed description corresponding to the illustrated embodiments. The term "longitudinal" as used throughout this detailed description and in the claims refers to a direction extending a length of a component. In some cases, the longitudinal direction of a sole structure may extend from a forefoot portion to a heel portion of the sole structure. Also, the term "lateral" as used throughout this detailed description and in the claims refers to a direction extending along a width of a component. As one example, the lateral direction of a sole structure may extend between a medial side and a lateral side of the sole structure. Furthermore, the term "vertical" as used throughout this detailed description and in the claims refers to a direction generally perpendicular to a lateral and longitudinal direction. For example, in cases where a sole structure is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn.

Although not shown here, sole structure 100 may be incorporated into an article of footwear and could include various provisions typically associated with articles of footwear such as an upper. In some embodiments, the shape, size, design and material constructions of the upper used with sole structure 100 may be selected according to factors including, but not limited: intended types of activities, durability, fit, comfort, design preferences as well as possibly other factors.

In some embodiments, sole structure 100 may be configured to provide traction for an article. In addition to providing traction, sole structure 100 may attenuate ground reaction forces when compressed between the foot and the ground during walking, running or other ambulatory activities. The configuration of sole structure 100 may vary significantly in different embodiments to include a variety of conventional or non-conventional structures. In some cases, the configuration of sole structure 100 can be configured according to one or more types of ground surfaces on which sole structure 100 may be used. Examples of ground surfaces include, but are not limited to: natural turf, synthetic turf, dirt, as well as other surfaces.

As described in further detail below, sole structure 100 may be configured to undergo various types and degrees of flexure, including bending and torsion. In order to characterize the types of flexure, the embodiments discuss a reference longitudinal axis 120, a reference lateral axis 122 and a reference vertical axis 124. Reference longitudinal axis 120 is an axis that may be generally parallel with the lengthwise, or longitudinal, direction of sole structure 100 when sole structure 100 is in an un-stressed or non-flexed state. Likewise, reference lateral axis 122 is an axis that may be generally parallel with the widthwise, or lateral, direction of sole structure 100 when sole structure 100 is in an un-stressed or non-flexed state. Finally, reference vertical axis 124 is an axis that may be generally perpendicular to reference lateral axis 122 and also perpendicular to reference longitudinal axis 120. It is to be understood that reference longitudinal axis 120, reference lateral axis 122 and reference vertical axis 124 are defined by reference to the unstressed or non-flexed state of sole structure 100. Moreover, as sole structure 100 is flexed or otherwise deformed, parts of sole structure 100 may be displaced in their longitudinal, lateral and/or vertical positions, as defined by these reference axes.

With the previously described reference axes in mind, several types of flexing or temporary deformation (i.e., elastic deformation) are characterized herein. The term "vertical bending" is used throughout this detailed description and in the claims to describe bending in which the vertical positions (as defined by a reference vertical axis) of some (but not all) portions of sole structure 100 change while the lateral positions of these portions remain unchanged. As an example, vertical bending may occur when the forefoot portion of sole structure 100 remains in contact with a ground surface but the heel portion is lifted off the ground.

The term "lateral bending" is used throughout this detailed description and in the claims to describe bending in which the lateral positions (as defined by a reference lateral axis) of some (but not all) portions of sole structure 100 change while the vertical positions of these portions remain unchanged. As an example, lateral bending may occur when the heel portion of sole structure 100 remains in place on a ground surface while the forefoot portion is bent towards the lateral or medial direction.

Finally, the term "torsion" is used throughout this detailed description and in the claims to describe the twisting of some (but not all) portions of sole structure 100 about a reference longitudinal axis. As an example, torsion in sole structure 100 may occur if the heel portion of sole structure 100 is twisted about reference longitudinal axis 120 while the forefoot portion remains engaged with a ground surface. Further examples of some possible types of bending and/or torsion are described in further detail below, especially as they relate to the behavior of sole structure 100 under some types of stresses.

Figure 2:
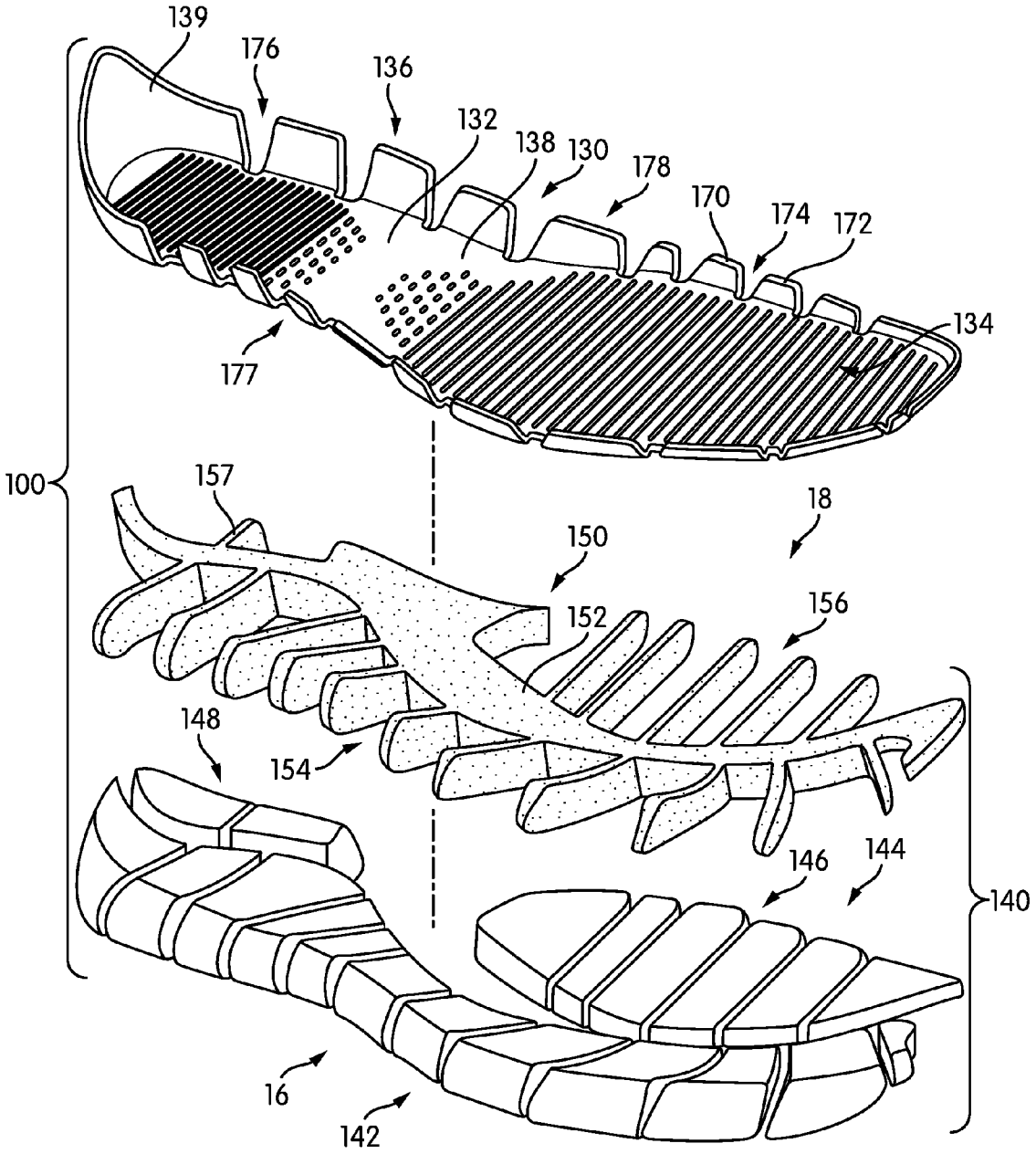
FIG. 2 is an exploded isometric view of the sole structure of FIG. 1.
Figure 3:
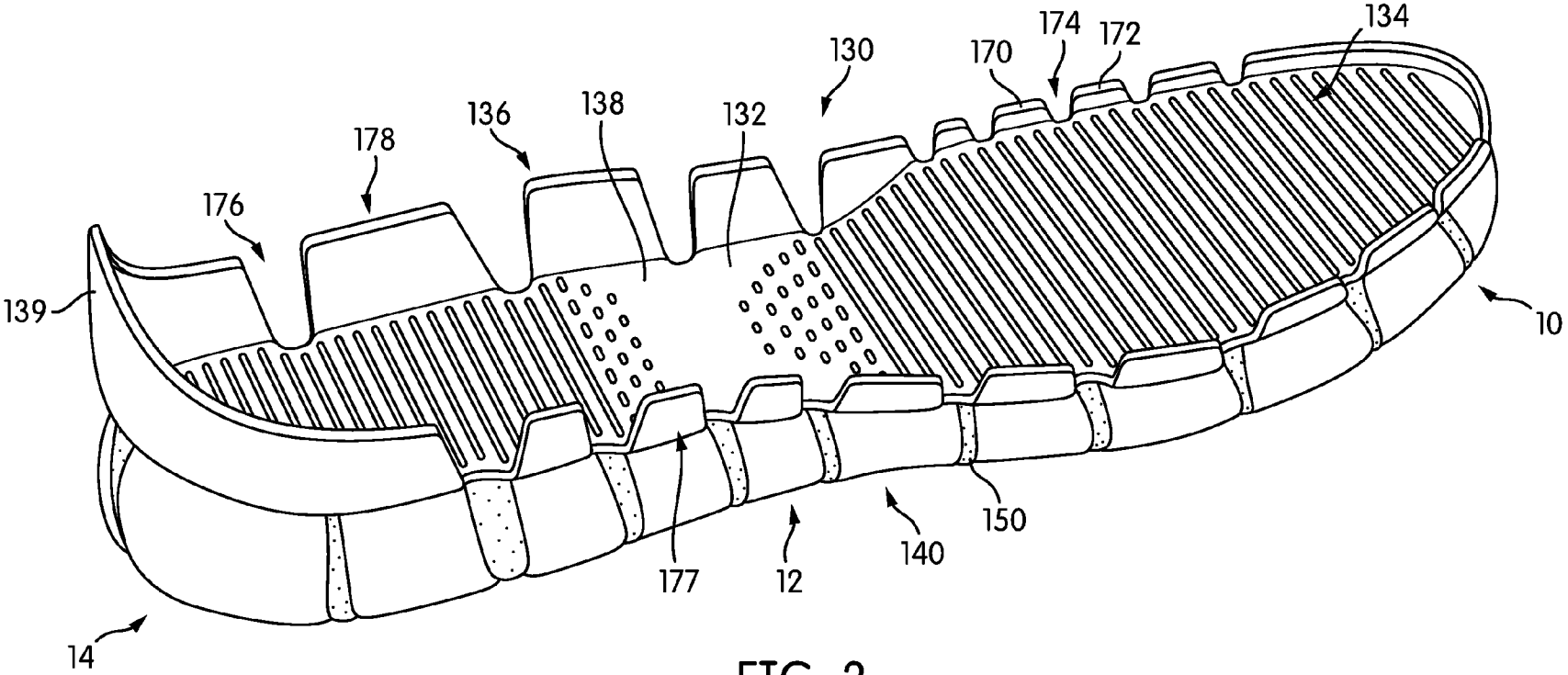
FIG. 3 is another isometric view of the sole structure of FIG. 1.

FIG. 2 illustrates an isometric exploded view of an embodiment of sole structure 100, while FIG. 3 illustrates another isometric view of an embodiment of sole structure 100. Referring now to FIGS. 1-3, sole structure 100 may comprise various components including a plate member 130, a plurality of segmented portions 140 and a compressible member 150. In some embodiments, plate member 130 may be proximal to plurality of segmented portions 140 and compressible member 150. In other words, plate member 130 may be disposed closer to the foot-receiving cavity of an article of footwear than plurality of segmented portions 140 and compressible member 150. Furthermore, plurality of segmented portions 140 and compressible member 150 may be assembled together in a manner that forms an approximately smooth ground engaging surface 160 (see FIG. 4) for sole structure 100. In other embodiments, however, sole structure 100 may include an additional outsole member that is disposed against the lower surfaces of plurality of segmented portions 140 and the lower surface of compressible member 150.

In some embodiments, plate member 130 may comprise a generally flat base portion 132. In some embodiments, base portion 132 may be substantially thin. In other words, the thickness of base potion 132 may be substantially less than both the length and width of base portion 132.

In some embodiments, base portion 132 may further include a plurality of flex grooves 134. In some embodiments, plurality of flex grooves 134 may be distributed through a substantial entirety of base portion 132, including a forefoot portion 10, midfoot portion 12 and heel portion 14 of sole structure 100. However, in other embodiments, plurality of flex grooves 134 could be primarily disposed within forefoot portion 10 and heel portion 14, with few to no flex grooves in midfoot portion 12. The use of one or more flex grooves may facilitate increased flexibility for plate member 130. In some cases, the use of flex grooves can improve vertical bending and/or torsion of plate member 130.

In some embodiments, plate member 130 may include a plurality of side sections 136. Plurality of side sections 136 may generally extend away from an outer peripheral edge 138 of base portion 132. In some embodiments, plurality of side sections 136 may extend in a partially vertical direction. Moreover, plurality of side sections 136 may extend away from plurality of segmented portions 140.

In different embodiments, the geometry of each side section could vary. In some embodiments, some side sections of plurality of side sections 136 may have an approximately rectangular geometry. In some cases, some side sections could have an approximately trapezoidal geometry. In still other cases, other geometries are possible, including, but not limited to: rounded, polygonal, regular and irregular geometries.

As seen in the figures, adjacent side sections may be spaced apart from one another. For example, a first side section 170 and a second side section 172 (associated with forefoot portion 10) could be spaced apart by a gap 174. Similarly, adjacent side sections throughout plate member 130 may be separated by gaps, which together comprise plurality of gaps 176.

In different embodiments, the sizes of side sections could vary. In some embodiments, the longitudinal length, lateral width and thickness of each side section could vary in any manner. As one possible example, the embodiments illustrate a configuration where the height of plurality of side sections 136 decreases in an approximately gradual manner from heel portion 14 to forefoot portion 10. Also, as seen in the figures, the lateral widths of each side section may vary, so that some side sections are wider than others. The height and thickness of side sections could be selected according to factors including desired flexibility of the sides of plate member 130 as well as desired support on the sides of the foot.

In some embodiments, the thickness of plurality of side sections 136 could vary in any manner. In some embodiments, each side section of plurality of side sections has a thickness that is approximately equal to the thickness of base portion 132. In other embodiments, however, one or more side sections could be thicker than base portion 132. In still other embodiments, one or more side sections could be thinner than base portion 132. The thickness of side sections could be selected according to factors including desired flexibility of the sides of plate member 130.

The arrangement of side sections shown in the exemplary embodiment provides peripheral sidewall portions for sole structure 100 that help keep a foot from sliding or moving outside of the outer periphery of sole structure 100. In particular, plurality of side portions 136 may present a first side wall 177 and a second side wall 178 on opposing sides of sole structure 100.

In some embodiments, sole structure 100 may also be provided with a raised heel section 139 that extends upwardly from base portion 132. In some embodiments, raised heel section 139 extends around part of heel portion 14, and may be further associated with plurality of side sections 136. The use of a raised heel section 139 may provide an integrated heel cup or heel counter on sole structure 100. This arrangement may facilitate increased support for the heel of the foot, and may work in conjunction with the support provided to the sides of the foot by first side wall 177 and second side wall 178. Additionally, as discussed below, the use of side sections and a heel section along the periphery of plate member 130 may help improve resistance to lateral bending for sole structure 100.

In some embodiments, the use of flex grooves on a base portion and gaps in the side walls can be coordinated. In particular, in some cases, the configuration of flex grooves (including number, size and location) can be selected according to the configuration of gaps between side sections (and vice versa). In an exemplary embodiment, plurality of flex grooves 134 may be more numerous than plurality of gaps 176. Moreover, as seen in the figures, each gap in plurality of gaps 176 may be substantially wider than the flex grooves of plurality of flex grooves 134. This configuration may allow for enhanced vertical bending while limiting lateral bending as discussed in further detail below.

As described herein, plate member 130 comprises a member for directly supporting a foot. Plate member 130 itself may be supported below (i.e., in a distal direction) by plurality of segmented portions 140 and compressible member 150, which together form a lower layer for sole structure 100. The particular configuration of plurality of segmented portions 140 and compressible member 150 may help accommodate some forms of bending and torsion, while limiting others (especially lateral bending).

Referring now to FIG. 2, in some embodiments, plurality of segmented portions 140 are disposed distally to plate member 130. In some embodiments, plurality of segmented portions 140 may be comprised of different sets or groups, each of which may be associated with different portions of sole structure 100. In some embodiments, plurality of segmented portions 140 includes a first set of segmented portions 142 and a second set of segmented portions 144. First set of segmented portions 142 may be associated with a first side of sole structure 100, while second set of segmented portions 144 may be associated with a second side of sole structure 100. In an exemplary embodiment, first set of segmented portions 142 may be associated with lateral side 16 of sole structure 100 while second set of segmented portions 144 may be associated with medial side 18 of sole structure 100.

In some embodiments, second set of segmented portions 144 may be further grouped into a forefoot segmented portion group 146 and a heel segmented portion group 148. Thus, in contrast to first set of segmented portions 142 that are distributed approximately evenly on lateral side 16 of sole structure 100, second segmented portions 144 are disposed primarily on forefoot portion 10 and heel portion 14 of sole structure 100.

Some embodiments may comprise one or more traction elements that are attached to plurality of segmented portions 140. In some embodiments, traction elements could be integrally formed with plurality of segmented portions 140. In an exemplary embodiment, each segmented portion comprises one or more traction elements 149 (see FIG. 4). In other embodiments, however, traction elements may be separately formed and attached to segmented portions using adhesives or other bonding techniques known in the art. In still other embodiments, traction elements could be optional.

As seen most clearly in FIG. 2, plurality of segmented portions 140 may comprise segmented portions of varying shapes and sizes. In some embodiments, segmented portions may generally have irregular shapes, though some segmented portions may have cross-sectional geometries that are approximately rectangular and/or trapezoidal. In an exemplary embodiment, the geometry of each segmented portion may be selected to accommodate the overall geometry of sole structure 100. For example, the lateral edges of segmented portions in first set of segmented portions 142 may be shaped to provide a contoured lateral outer sidewall for sole structure 100. Similarly, the medial edges of segmented portions in second set of segmented portions 144 may be shaped to provide a contoured medial outer sidewall for sole structure 100.

Referring to FIGS. 1-3, as previously discussed, embodiments can include a compressible member 150. In some embodiments, compressible member 150 comprises a member that is substantially compressible relative to adjacent components. For example, in an exemplary embodiment, compressible member 150 has a compressibility that is substantially greater than the compressibility of plurality of segmented portions 140. As discussed in detail below, compressible member 150 may be configured to fill in gaps between plurality of segmented portions 140, which may be spaced apart from one another in sole structure 100.

In some embodiments, compressible member 150 may comprise additional material characteristics that benefit the operation of sole structure 100. In some embodiments, for example, compressible member 150 could have high energy return properties. In addition, in some embodiments, compressible member 150 could provide enhanced cushioning.

In different embodiments, compressible member 150 could be made of various materials. Exemplary materials include, but are not limited to: foams, including soft foams and hard foams, as well as rubber. Other embodiments could utilize still other materials for some or all of compressible member 150.

Figure 4:
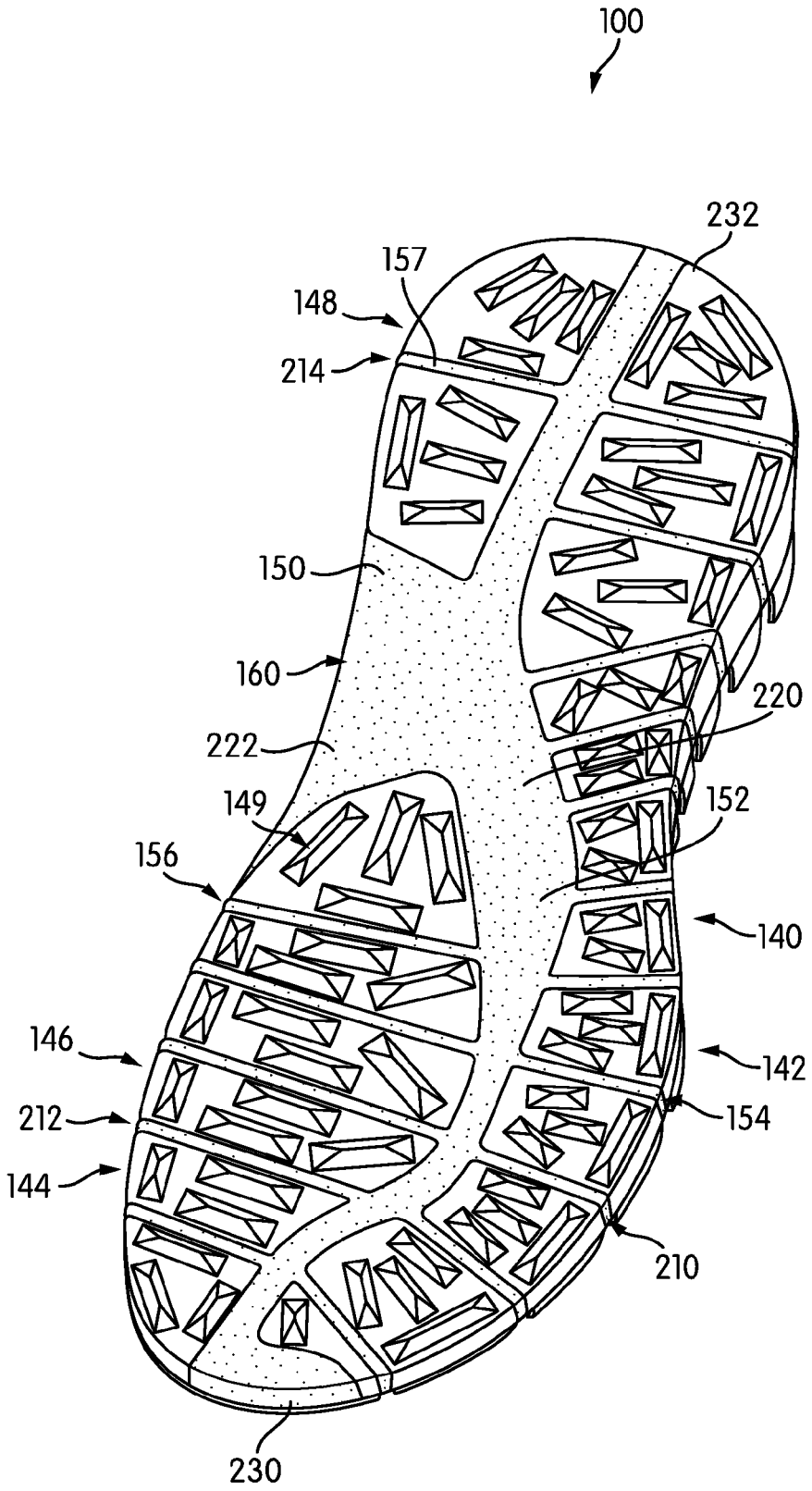
FIG. 4 is a bottom isometric view of the sole structure of FIG. 1.
Figure 5:
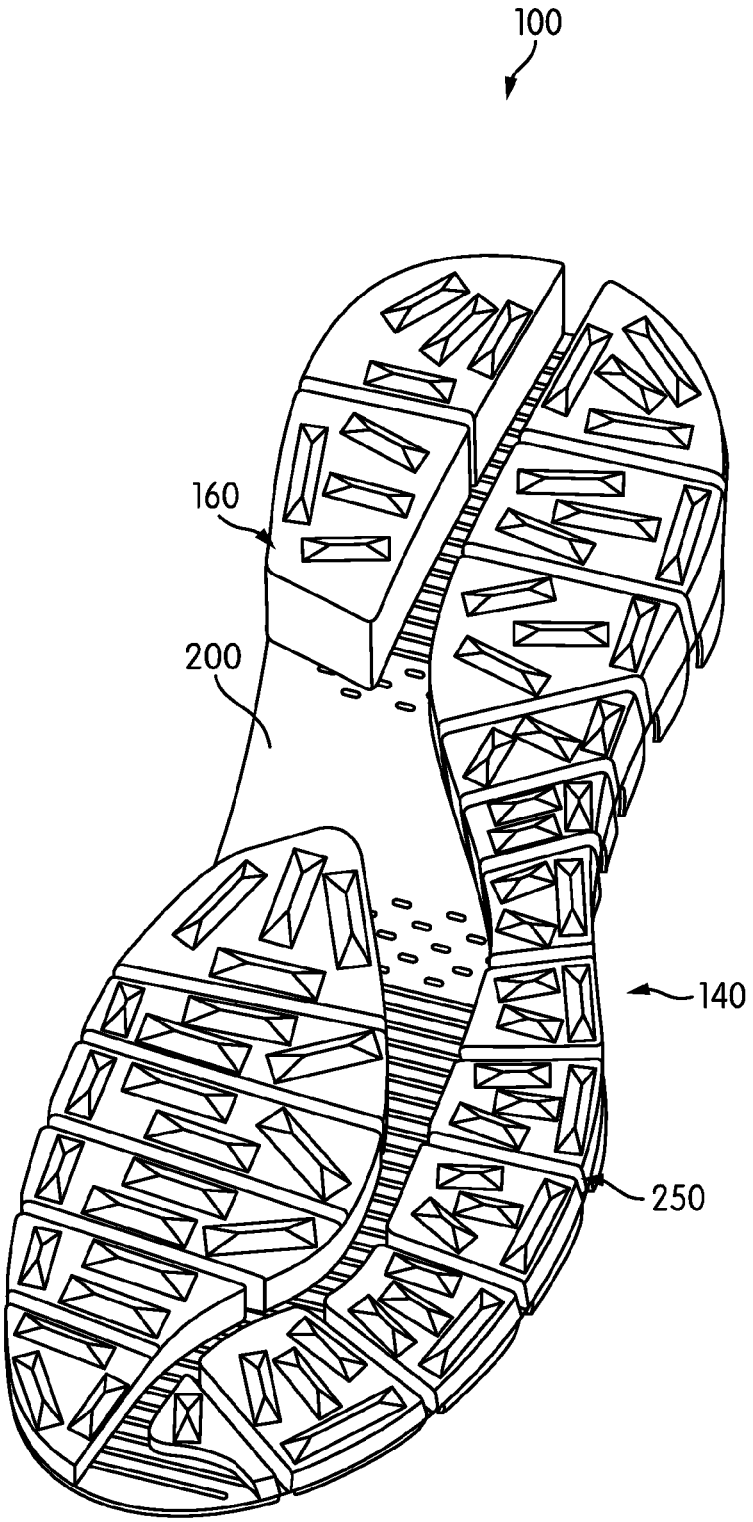
FIG. 5 is a bottom isometric view of the sole structure of FIG. 1, in which a portion of the sole structure has been removed.

FIG. 4 illustrates a schematic assembled isometric view of sole structure 100, in which the relative configurations of plate member 130, segmented portions 140 and compressible member 150 can easily be seen. FIG. 5 illustrates an isometric view of plate member 130 and segmented portions 140, without compressible member 150, so that the intrinsic geometry of the spaces or gaps filled by compressible member 150 is clearly visible.

Referring to FIGS. 4 and 5, as previously mentioned, plurality of segmented portions 140 may be attached to a lower or distal surface 200 of plate member 130 (visible in FIG. 5). In some embodiments, plurality of segmented portions 140 extend away from distal surface 200 of plate member 130 and form part of ground contacting surface 160 for sole structure 100.

Generally, plurality of segmented portions 140 may be attached or otherwise joined to plate member 130 in any manner. In some cases, plurality of segmented portions 140 could be bonded to plate member 130. In other embodiments, plate member 130 and plurality of segmented portions 140 may be formed as an integral or unitary component. Methods for forming such a unitary component may include molding as well as three-dimensional printing.

Plurality of segmented portions 140 may be positioned on distal surface 200 such that adjacent segmented portions are spaced apart from one another. In other words, in some embodiments, no two segmented portions of plurality of segmented portions 140 may be in direct contact with each other. In other embodiments, some segmented portions may be in direct contact, while others may be spaced apart.

In some embodiments, segmented portions may be separated by flexing regions of sole structure 100. As discussed in further detail below, the term "flexing region" refers to a region between segmented portions that can contract or expand in size such that the segmented portions may be moved closer together or further apart. In some embodiments, a flexing region may be achieved through the use of gaps or channels that separate two or more segmented portions. In some embodiments, a flexing region may comprise material portion (e.g., a foam portion) of sole structure 100 that can expand or contract in size such that the segmented portions may be moved closer together or further apart.

Referring now to FIG. 4, plurality of segmented portions 140 may be separated by flexing regions. In some embodiments, adjacent segmented portions within first set of segmented portions 142 may be separated by a first set of flexing regions 210. Likewise, adjacent segmented portions within forefoot segmented portion group 146 of second set of segmented portions 144 may be separated by a second set of flexing regions 212. Furthermore, segmented portions of heel segmented portion group 148, which comprises only two segmented portions in the exemplary embodiment, may be separated by flexing region 214.

First set of segmented portions 142 and second set of segmented portions 144 may also be separated by a central flexing region 220. In some embodiments, central flexing region 220 may extend from a forward edge 230 to a rearward edge 232 of sole structure 100. In some embodiments, central flexing region 220 may be further connected to a medial arch flexing region 222, which may separate forefoot segmented portion group 146 from heel segmented portion group 148.

As previously discussed, flexing regions can be formed from gaps and/or from material portions that allow for relative motion between adjacent segmented portions. In the exemplary embodiment shown in FIG. 4, each flexing region is comprised of a material portion that can be compressed or expanded between adjacent segmented portions, thereby facilitating flexing. Further, the degree and direction of flexing may generally depend on factors including the size, orientation and material properties of the particular flexing region.

In an exemplary embodiment, each flexing region may be associated with a portion of compressible member 150, which may fill in the plurality of gaps 250 (see FIG. 5) that separate plurality of segmented portions 140. For example, referring now to FIGS. 2 and 4, central flexing region 220 is comprised of a central longitudinal portion 152 of compressible member 150. Likewise, first set of flexing regions 210 may be comprised of a first set of projecting portions 154 that extend from central longitudinal portion 152. In a similar manner, second set of flexing regions 212 may be comprised of a second set of projecting portions 156 that extend from central longitudinal portion 152. Still further, flexing region 214 may be comprised of a projecting portion 157 that extends from central longitudinal portion 152.

In an exemplary embodiment, the projecting portions of compressible member 150 may fill gaps created by the spacing between adjacent segmented portions. For example, first set of projecting portions 154, second set of projecting portions 156 and projecting portion 157 may fill in plurality of gaps 250 (shown in FIG. 5). With this configuration, each segmented portion is separated from nearby segmented portions by one or more projecting portions.

Figure 6:
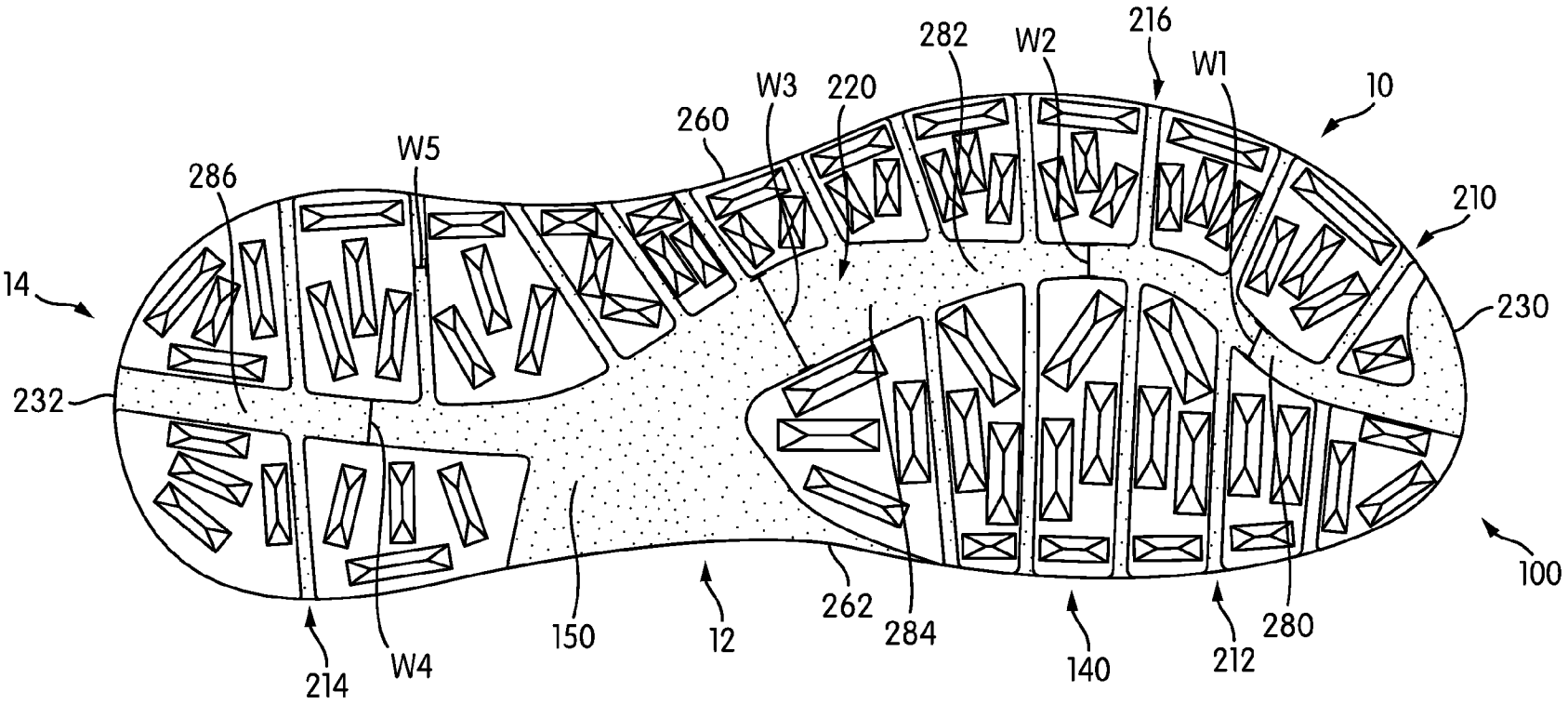
FIG. 6 is a bottom view of an embodiment of the sole structure of FIG. 1.

FIG. 6 illustrates a bottom view of an embodiment of sole structure 100. Referring to FIG. 6, flexing regions may be arranged on sole structure 100 in a manner that enhances some modes or types of flexing (such as vertical bending and torsion) and resists others (such as lateral bending).

In some embodiments, central flexing region 220 may extend in an approximately longitudinal direction on sole structure 100. In contrast, in some embodiments, one or more flexing regions from first set of flexing regions 210 and second set of flexing regions 212 may extend in a lateral or partially lateral (e.g., diagonal) direction. In some cases, flexing region 214 may also extend in a lateral or partially lateral (e.g., diagonal) direction. Moreover, first set of flexing regions 210 may each extend from central flexing region 220 to a first side edge 260 of sole structure 100, while second set of flexing regions 212 and flexing region 214 may each extend from central flexing region 220 to a second side edge 262 of sole structure 100.

For purposes of further describing the characteristics of various flexing regions, first set of flexing regions 210, second set of flexing regions 212 and flexing region 214 may be collectively referred to as a plurality of outwardly extending flexing regions 216, since each of these flexing regions extends outwardly from central flexing region 220 towards first side edge 260 or second side edge 262 of sole structure 100.

In some embodiments, the geometry of flexing regions could vary. In some embodiments, flexing regions comprising plurality of outwardly extending flexing regions 216 could have a substantially linear or straight geometry. In other embodiments, however, flexing regions comprising plurality of outwardly extending flexing regions 216 could have substantially non-linear geometries that bend, arc or otherwise curve between central flexing region 220 and the side edges of sole structure 100.

In some embodiments, central flexing region 220 may have a linear geometry that is approximately straight. In other embodiments, central flexing region 220 may have a non-linear geometry that bends, arcs or curves between forward edge 230 and rearward edge 232 of sole structure 100. In an exemplary embodiment, central flexing region 220 may have a non-linear geometry. More specifically, central flexing region 220 may be comprised of multiple non-parallel sections, including a first section 280, a second section 282, a third section 284 and a fourth section 286. In this case, first section 280 and second section 282, which extend within forefoot portion 10, are angled and non-parallel with one another. Likewise, second section 282 and third section 284 are angled and non-parallel with respect to one another. Finally, third section 284 and fourth section 286 are angled and non-parallel with one another.

In some embodiments, the approximate widths of different flexing regions could vary. In some cases, the approximate widths of flexing regions in plurality of outwardly extending flexing regions 216 may have approximately similar widths. However, in other cases, the widths of flexing regions comprising first set of flexing regions 210, second set of flexing regions 212 and flexing region 214 could vary in any other manner, including utilizing different widths between segmented portions along different portions of sole structure 100.

In some embodiments, the width of central flexing region 220 may vary with respect to the longitudinal direction. In an exemplary embodiment, first section 280 may have a first width W1, second section 282 may have a second width W2, third section 284 may have a third width W3 and fourth section 286 may have a fourth width W4. As seen in FIG. 6, first width W1 may be less than second width W2. Also, second width W2 may be still less than third width W3. Finally, fourth width W4 may be less than width W4. It is clear therefore, that in some embodiments, central flexing region 220 has a width that increases from forefoot portion 10 to midfoot portion 12, and then decreases again from midfoot portion 12 to heel portion 14. This variable width configuration for central flexing region 220 allows the flexibility of sole structure 100 to be tuned at different locations. For example, the wider width of central flexing region 220 at midfoot portion 12 may help improve torsion about midfoot portion 12.

In some embodiments, the relative sizes of central flexing region 220 and plurality of outwardly extending flexing regions 216 could vary. For example, in an exemplary embodiment, plurality of outwardly extending flexing regions 216 may be associated with an average width of W5. It is clear from FIG. 6, that in at least some embodiments, the average width W5 of flexing regions comprising plurality of outwardly extending flexing regions 216 is substantially smaller than a minimum width of central flexing region 220. In this embodiment, the minimum width of central flexing region 220 is seen to be width W1 in first section 280. Moreover, it is clear that width W1 is substantially greater than width W5.

The relative differences in widths between central flexing portion 220 and flexing portions comprising plurality of outwardly extending flexing portions 216 may vary. In some embodiments, for example, the ratio of width W1 to width W5, where width W1 represents the minimum width of central flexing region 220 and width W5 represents the average width of flexing regions in plurality of outwardly extending regions 216 can have any value. Exemplary values for this ratio can include any values in the range between 150 to 500 percent. In other words, in some embodiments, width W1 may be anywhere from one and a half times greater than width W5, to five times greater than width W5. In still other embodiments, width W1 may be more than five times greater than width W5. Of course, in other embodiments, it is contemplated that width W1 could be approximately equivalent to width W5, and possibly even smaller than width W5.

Controlling the relative widths between central flexing region 220 and plurality of outwardly extending regions 216 can help tune different flexing modes of sole structure 100. For example, using relatively small widths for plurality of outwardly extending flexing regions 216 may help limit lateral bending, since there is little space for plurality of segmented portions 140 to move towards each other as the flexing regions are compressed under lateral stresses. Moreover, using a relatively larger width for central flexing region 220 may enhance torsion, since the high compressibility of central flexing region 220 may reduce resistance to torsion along the longitudinal axis.

Although the exemplary embodiment includes a medial arch flexing region 222 that separates segmented portions in the forefoot from segmented portions in the heel along the medial side of sole structure 100, other embodiments may not include this flexing region. In some other embodiments, for example, the region spanned by medial arch flexing region 222 could include additional segmented portions that provide a similar continuity of segmented portions on the medial side as occurs on the lateral side.

Figure 7:
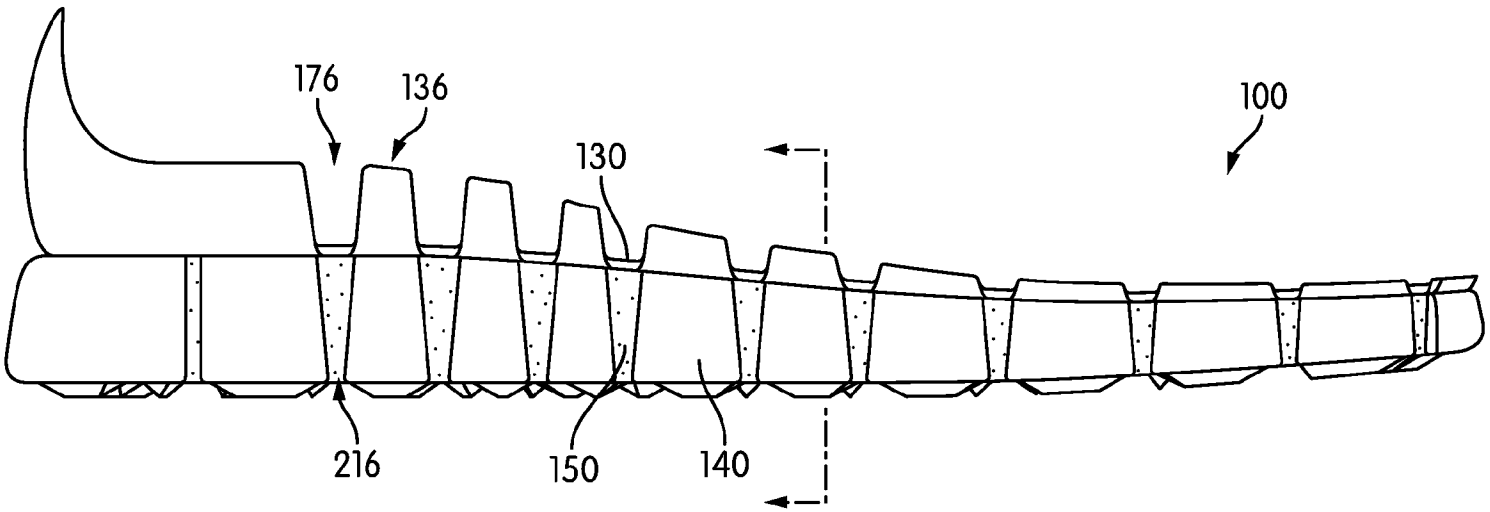
FIG. 7 is a schematic side view of an embodiment of a sole structure.
Figure 7:
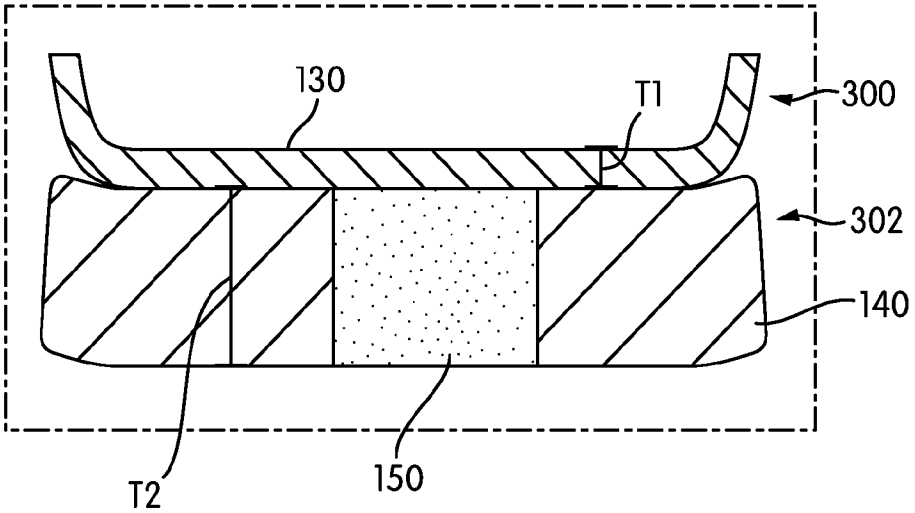

FIG. 7 illustrates a schematic side view and a cross-sectional view, respectively, of sole structure 100. As seen in FIG. 7, the relative thickness of plate member 130 and plurality of segmented portions 140 may vary significantly in some embodiments. For purposes of describing the thicknesses of various components, reference is made to an upper layer 300 of sole structure 100 and a lower layer 302 of sole structure. Upper layer 300 is comprised of plate member 130, while lower layer 302 is comprised of plurality of segmented portions 140 and compressible member 150. It is assumed that in at least some embodiments, plurality of segmented portions 140 and compressible member 150 have similar thicknesses with respect to the vertical direction.

Because upper layer 300 (comprised of plate member 130) may have a more unitary construction than lower layer 302, it may be useful to have a reduced thickness for upper layer 300 relative to the thickness of lower layer 302. In particular, the thickness of upper layer 300 may be reduced in order to achieve similar levels of flexibility to lower layer 302, which achieves flexibility through the use of flexing regions.

In the exemplary embodiment, upper layer 300 is seen to have a thickness T1, while lower layer 302 has a thickness T2. In some embodiments, thickness T2 is substantially greater than thickness T1. For example, in some cases, thickness T2 could be at least twice as large as thickness T1. In still other cases, thickness T2 could be at least five times as large as thickness T1.

As previously discussed, flexure or elastic deformation of portions of sole structure 100 may be achieved within different components through the use of different materials and different material structures. In an exemplary embodiment, for example, plate member 130 and plurality of segmented portions 140 may both comprise relatively rigid materials relative to compressible member 150, which forms the flexing regions and which may be further made of compressible materials such as foam. Flexing in the upper layer 300 (comprised of plate member 130) is achieved using a relatively thin layer of material in combination with flex grooves (within the base) and gaps (separating side sections). Flexing within the lower layer 302 (comprised of plurality of segmented portions 140 and compressible member 150) is accomplished by forming flexing regions that separate segmented portions and allow for some relative movement between the segmented portions. In particular, using a substantially flexible material such as foam allows the flexing regions to compress or otherwise flex such that adjacent segmented portions are able to move slightly relative to one another.

As shown in FIG. 7, in some embodiments, plurality of gaps 176 that separate plurality of side sections 136 may be approximately aligned with plurality of outwardly extending flexing regions 216. By aligning plurality of gaps 176 with flexing regions 216, upper layer 300 and lower layer 302 may be configured to bend and twist at similar locations, thereby facilitate bending of the entire sole structure.

Figure 8:
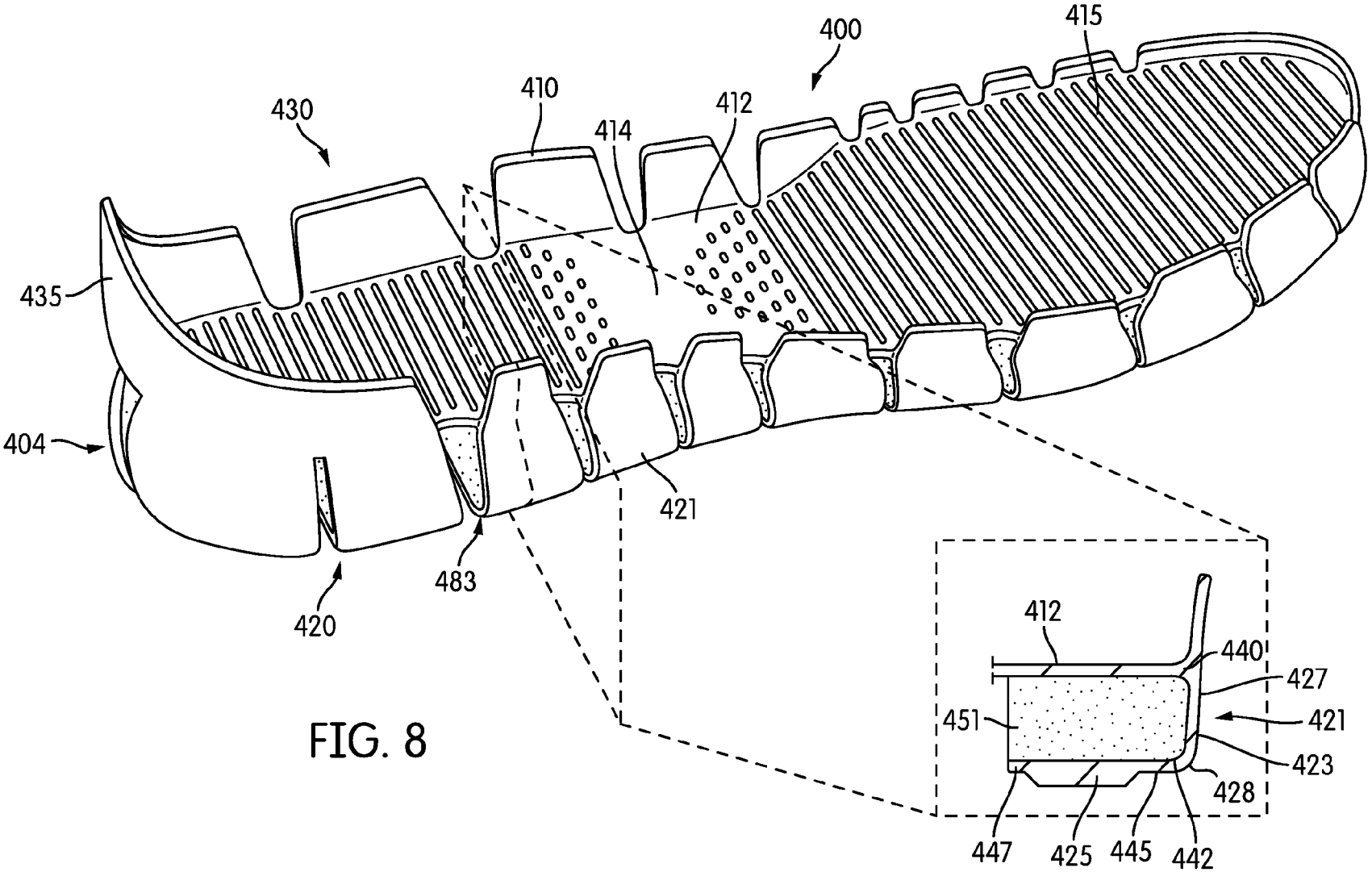
FIG. 8 is a schematic isometric view of an embodiment of a sole structure for an article of footwear.
Figure 9:
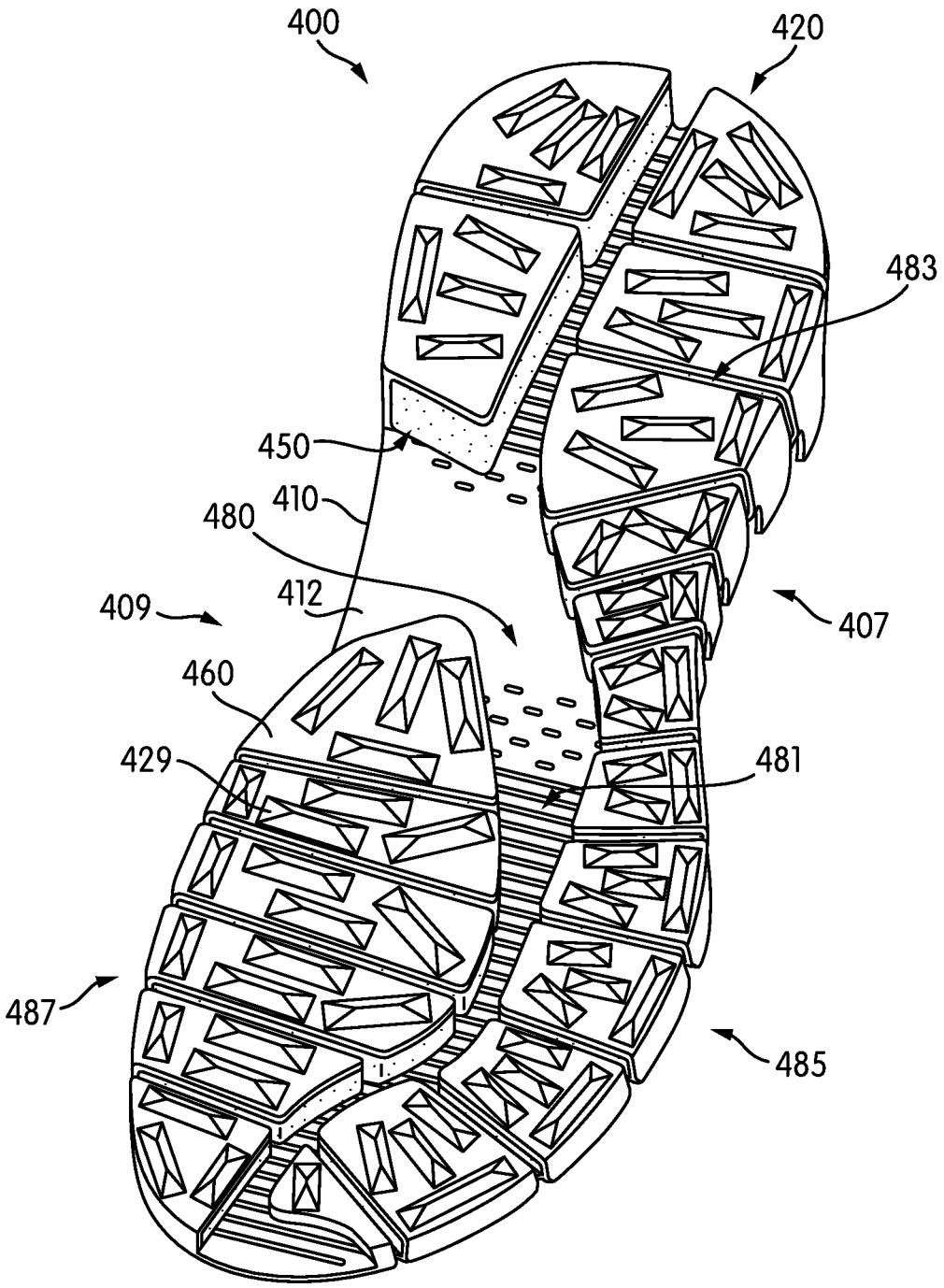
FIG. 9 is a schematic bottom isometric view of the sole structure of FIG. 8.

FIGS. 8 and 9 illustrate schematic isometric views of another embodiment of a sole structure. In particular, FIG. 8 illustrates a schematic isometric view of a top side of a sole structure 400, while FIG. 9 illustrates a schematic isometric view of a bottom side of sole structure 400. FIG. 8 further includes an enlarged cross-sectional view of a portion of sole structure 400.

Referring now to FIGS. 8-9, sole structure 400 may comprise substantially monolithic sole member 410. In particular, in contrast to a previous embodiment that included a separate plate member and segmented portions that were bonded together, the embodiment of FIGS. 8-9 comprises a sole member 410 having integrated plate portion 412, lower segmented portions 420 and upper sidewall portions 430. Sole structure 400 may be further associated with a plurality of separable compressible portions 450, which may be disposed below plate portion 412 as discussed in further detail below.

In some embodiments, plate portion 412 provides an approximately flat first side 414 that is configured to provide support for a foot (either directly when a foot directly contacts first side 414, or indirectly when a foot contacts an intermediate liner, insole or other layer). In some embodiments, plate portion 412 may optionally include a plurality of flex grooves 415.

As seen most clearly in FIG. 8, upper side sections 430 may extend proximally from plate portion 412, such that upper side sections 430 may provide support to the sides of the foot. In some embodiments, upper side sections 430 may be spaced apart from one another. As with previous embodiments, upper side sections 430 may have any desired geometry, size and/or thickness. The dimensions, shape and thickness of upper side sections 430, as well as their relative spacing, could be selected according to factors including desired flexibility of the sides of sole structure 412 as well as desired support on the sides of the foot. The arrangement of side sections shown in the exemplary embodiment provides peripheral sidewall portions for sole structure 400 that help keep a foot from sliding or moving outside of the outer periphery of sole structure 400.

In some embodiments, sole structure 400 may also be provided with a raised heel section 435 that extends upwardly from plate member 412. In some embodiments, raised heel section 435 extends around part of heel portion 404 of sole structure 400, and may be further associated with upper side sections 430. The use of a raised heel section 404 may provide an integrated heel cup or heel counter on sole structure 400. This arrangement may facilitate increased support for the heel of the foot, and may work in conjunction with the support provided to the sides of the foot by upper side sections 430. Additionally, in some embodiments, the use of side sections and a heel section along the periphery of plate portion 412 may help improve resistance to lateral bending for sole structure 400.

As described herein, plate portion 412 comprises a member for directly supporting a foot. Plate portion 412 itself may be supported below (i.e., in a distal direction) by lower segmented portions 420 and plurality of compressible portions 450, which together form a lower layer for sole structure 400. The particular configuration of lower segmented portions 420 and plurality of compressible portions 450 may help accommodate some forms of bending and torsion, while limiting others (especially lateral bending).

In the exemplary embodiment, lower segmented portions 420 are seen to extend downwards (i.e., distally) from plate portion 412. In particular, lower segmented portions 420 may extend beneath plate portion 412 and form a ground engaging surface 460 for sole structure 400. As in previous embodiments, lower segmented portions 420 may include one or more traction elements 429 to facilitate improved traction with a ground surface.

In some embodiments, lower segmented portions 420 are each configured with a side portion and a bottom portion. For example, referring to FIG. 8, an exemplary lower segmented portion 421, shown in the enlarged cross-section, includes a side portion 423 and a bottom portion 425. Here, side portion 423 extends in an approximately vertically direction (distally from plate portion 412), while bottom portion 425 extends in an approximately horizontal direction (i.e., approximately parallel with plate portion 412). Moreover, an upper end portion 427 of side portion 423 is attached to plate portion 412 at an attachment region 440, while a lower end portion 428 of side portion 423 is attached to bottom portion 425 at an attachment region 442. Furthermore, a first end 445 of bottom portion 425 is attached to side portion 423, while a second end 447 of bottom portion 425 is a free end. This provides a cantilevered configuration for bottom portion 425. In some embodiments, this configuration may provide for bending at first attachment region 440 and/or second attachment region 442, depending on the materials used for lower segmented portion 421 and/or the thickness of lower segmented portion 421. Thus, by selecting the material and/or thickness of lower segmented portion 421, the degree of bending or flexing of lower deflecting portion 421 may be tuned.

As clearly seen in the cross-sectional view of FIG. 8, lower deflecting portion 421 may form a c-shaped channel with plate portion 412. Specifically, plate portion 412, side portion 423 and bottom portion 425 comprise the three sides of the c-shaped channel. This c-shaped channel configuration may help resist bending of lower deflecting portion 421 along a longitudinal direction of sole structure 400.

In order to facilitate the deflection of lower segmented portions 420, some embodiments may include plurality of compressible portions 450 as previously discussed. In the exemplary embodiment, lower segmented portion 421 may be further associated with a compressible portion 451. Specifically, compressible portion 451 has a size and geometry that fits into the channel or space formed between plate portion 412 and bottom portion 425 of lower segmented portion 421. In this exemplary configuration, compressible portion 421 has an approximately rectangular cross-sectional shape that may fit within the c-channel cavity formed by lower deflecting portion 421 and plate portion 412. This arrangement allows for compressible portion 451 to enhance the deflection properties of lower segmented portion 421. In some cases, for example, compressible portion 451 can provide increased support, stiffness and/or energy for sole structure 400.

The remaining lower segmented portions 420 may have a similar configuration to lower segmented portion 421. Similarly, each of lower segmented portions 420 may incorporate a corresponding compressible portion. In other embodiments, however, some lower segmented portions may not be configured with corresponding compressible portion.

In some embodiments, compressible portions 450 may comprise additional material characteristics that benefit the operation of sole structure 400. In some embodiments, for example, compressible portions 450 could have high energy return properties. In addition, in some embodiments, compressible portions 450 could provide enhanced cushioning.

In different embodiments, compressible portions 450 could be made of various materials. Exemplary materials include, but are not limited to: foams, including soft foams and hard foams, as well as rubber. In some embodiments, materials such as ethylene-vinyl-acetate (EVA), polyurethane, elastomers as well as other synthetic materials could be used. Other embodiments could utilize still other materials for some or all of compressible portions 450.

The arrangement described here and shown in FIGS. 8-9 may provide for enhanced cushioning and/or energy return. Specifically, in some embodiments, as sole structure 400 comes into contact with a ground surface, lower deflecting portions 420 may tend to deflect while compressible portions 450 are compressed. This may help provide enhanced cushioning to the foot during running, walking, or other activities. Upon the release of the initial force with a ground surface, lower deflecting portions 420 and compressible portions 450 may then provide a restoring force (for example, due to the cantilevered arrangement of lower deflecting portions 420) that provides energy return.

In the embodiments of FIGS. 8 and 9, a flexing region 480 is provided in the form of gaps between adjacent lower segmented portions. For example, a central flexing region 481 of flexing region 480 extends between a first set of lower deflecting portions 485 and a second set of lower deflecting portions 487, which are associated with a lateral side 407 and a medial side 409 of sole structure 400, respectively. Similarly, adjacent lower deflecting portions 420 may be separated in a longitudinal direction by outwardly extending flexing regions 483, which comprise gaps between adjacent lower deflecting portions 420. Flexing region 480 therefore may facilitate the flexing properties of sole structure 400, including its bending, twisting and/or other kinds of flexing.

Figure 10:
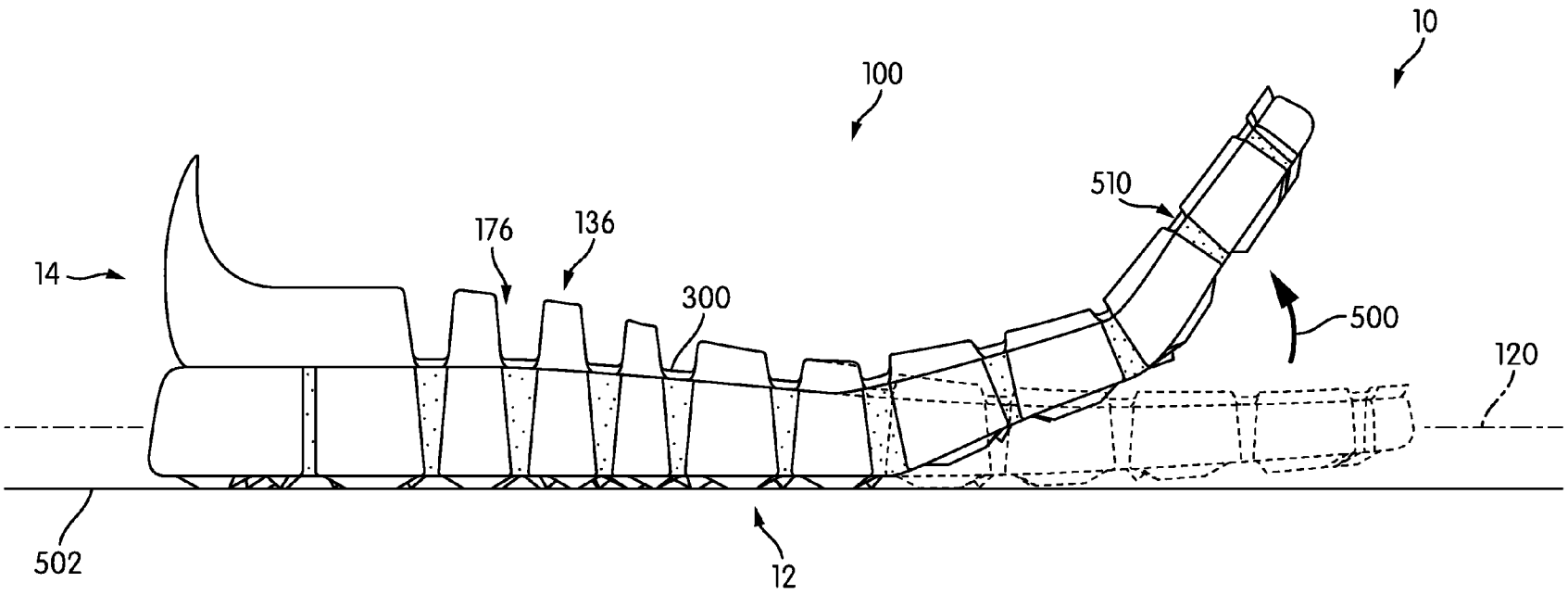
FIG. 10 is a schematic side view of an embodiment of a sole structure undergoing vertical bending.
Figure 11:
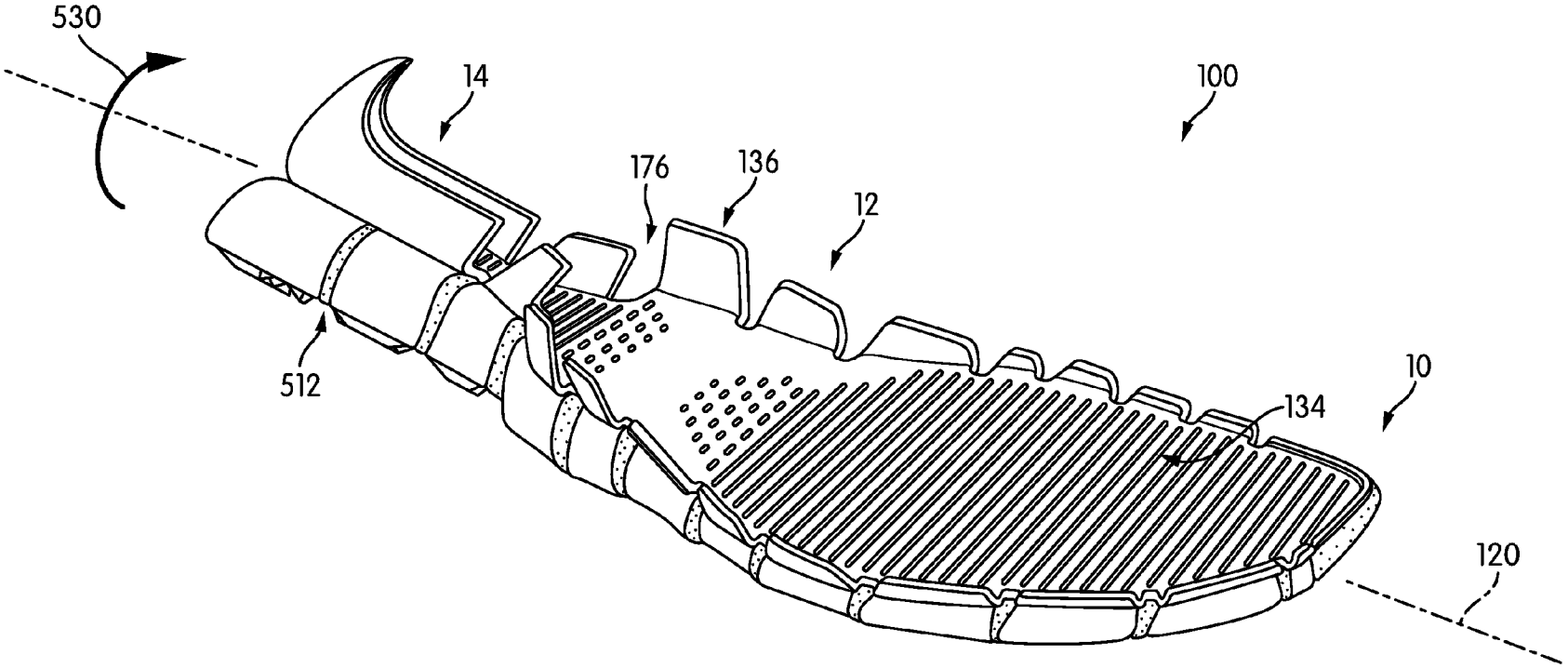
FIG. 11 is a schematic side view of an embodiment of a sole structure undergoing torsion.
Figure 12:
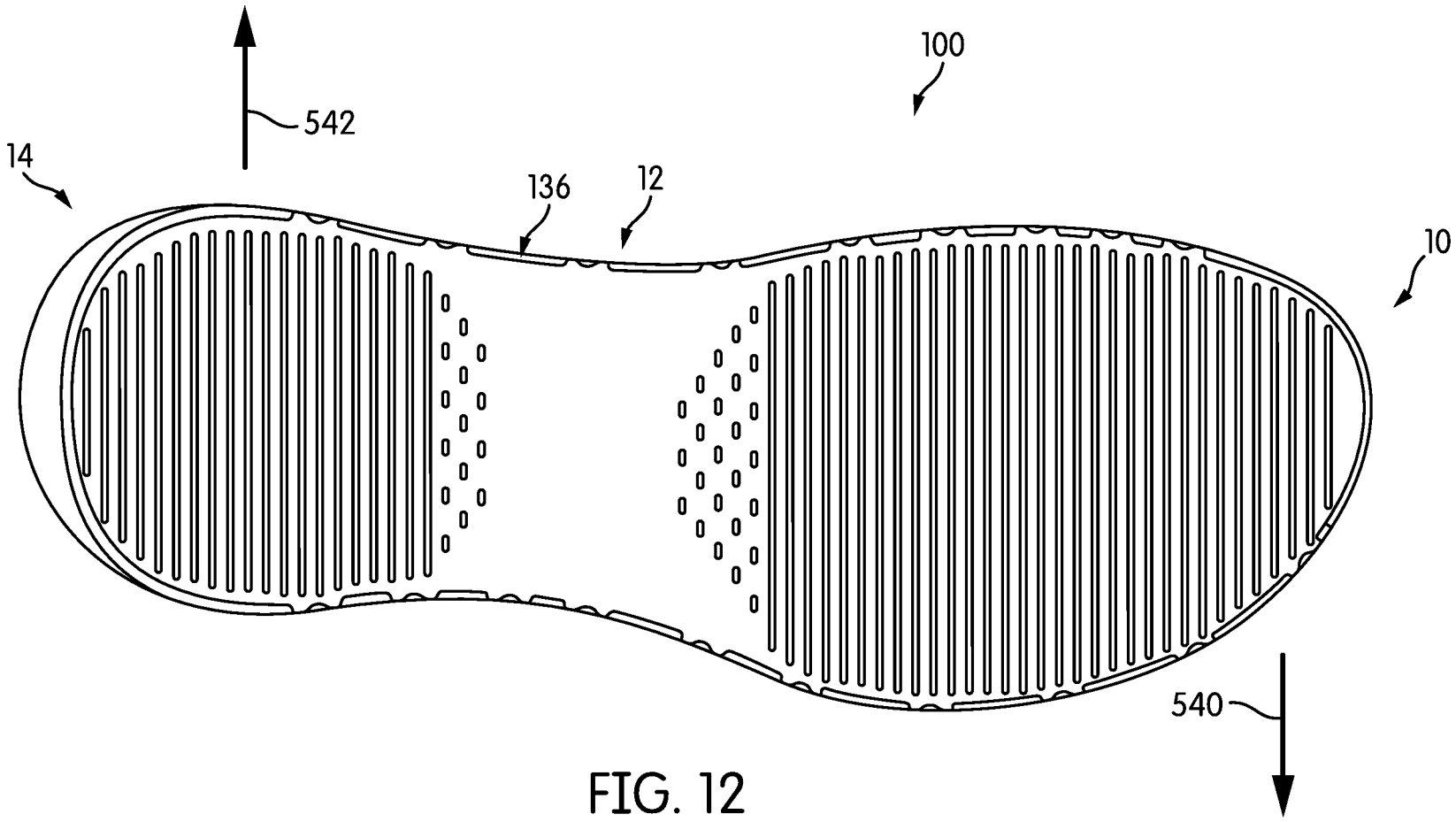
FIG. 12 is a schematic top down view of an embodiment of a sole structure, in which the sole structure resists lateral bending under applied shear forces.

FIGS. 10-12 illustrate the response of a sole structure having some of the properties discussed above to different kinds of stresses. For purposes of clarity, FIGS. 10-12 depict the flexing characteristics of sole structure 100, described above and shown in FIGS. 1-7. However, it should be understood that the flexing characteristics shown here may also be similar for other embodiments of a sole structure, including sole structure 400, which is described above and shown in FIGS. 8-9. Still other embodiments may have substantially similar flexing properties as well.

Referring first to FIG. 10, sole structure 100 is seen to undergo vertical bending as a force 500 is applied beneath forefoot portion 10. That vertical bending occurs is clear by noting that the vertical position of forefoot portion 10 changes with respect to reference longitudinal axis 120, from the unstressed configuration (shown in phantom) to the stressed configuration (shown in solid lines).

It will be understood that vertical bending occurs because heel portion 14 remains in place on a ground surface 502. Thus, there are forces applied at heel portion 14 (not shown) that keep heel portion 14 fixed in place on ground surface 502, thereby resulting in bending rather than a rigid rotation of sole structure 100.

The vertical bending seen in FIG. 10 is the result of local flexing/bending between adjacent segmented portions. Specifically, bending occurs as flexing regions 510 in forefoot portion 10, which are disposed between adjacent segmented portions, deform under stress. This vertical bending is also the result of bending in plate member 130, which is facilitated by flex grooves in plate member 130 (not visible) as well as plurality of gaps 176 between adjacent side sections 136 in forefoot portion 10.

Referring next to FIG. 11, sole structure 100 is seen to undergo torsion as torque 530 is applied at heel portion 14, about reference longitudinal axis 120. To achieve the torsion shown in FIG. 11, it may be assumed that various forces (not visible) keep forefoot portion 10 fixed in place as heel portion 14 twists.

The torsion seen in FIG. 11 is the result of local twisting between adjacent segmented portions. Specifically, the twisting occurs as flexing regions 512 in heel portion 14 deform under stress, thereby allowing adjacent segmented portions to tilt or rotate with respect to one another about reference longitudinal axis 120. Additionally, the torsion occurs as the result of twisting in plate member 130, due to the presence of plurality of flex grooves 134 and plurality of gaps 176 in adjacent side sections 136.

Referring next to FIG. 12, sole structure 100 may generally resist lateral bending under applied shear forces, including a first shear force 540 applied at forefoot portion 10 and a second shear force 542 applied at heel portion 14. The resistance to lateral bending under shear forces may occur because of the configuration of sole structure 100. As previously mentioned, the side sections 136 of plate member 130 form sidewall portions that may acts to resist lateral bending. Additionally, the relatively narrow widths of plurality of outwardly extending flexing regions 216 (not shown) may limit the relative movement of plurality of segmented portions 140 in the lateral direction. Thus, it can be seen by comparing FIGS. 10 through 12, that sole structure 100 is able to accommodate vertical bending and torsion about the longitudinal axis while resisting and/or limiting lateral bending that may occur when shear forces are applied.

Figure 13:
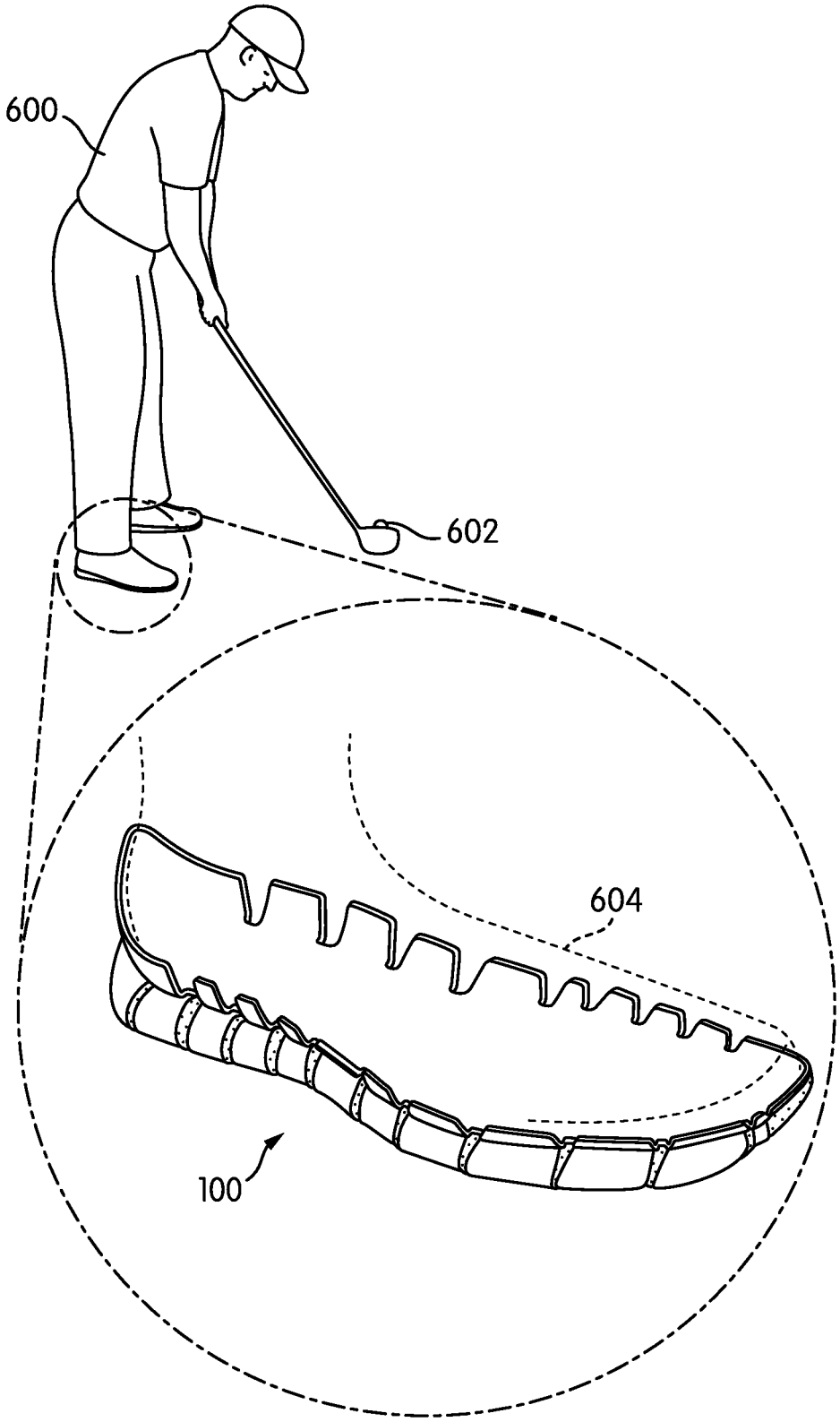
FIG. 13 is a schematic view of a golfer wearing an article that incorporates a sole structure, according to an embodiment.
Figure 14:
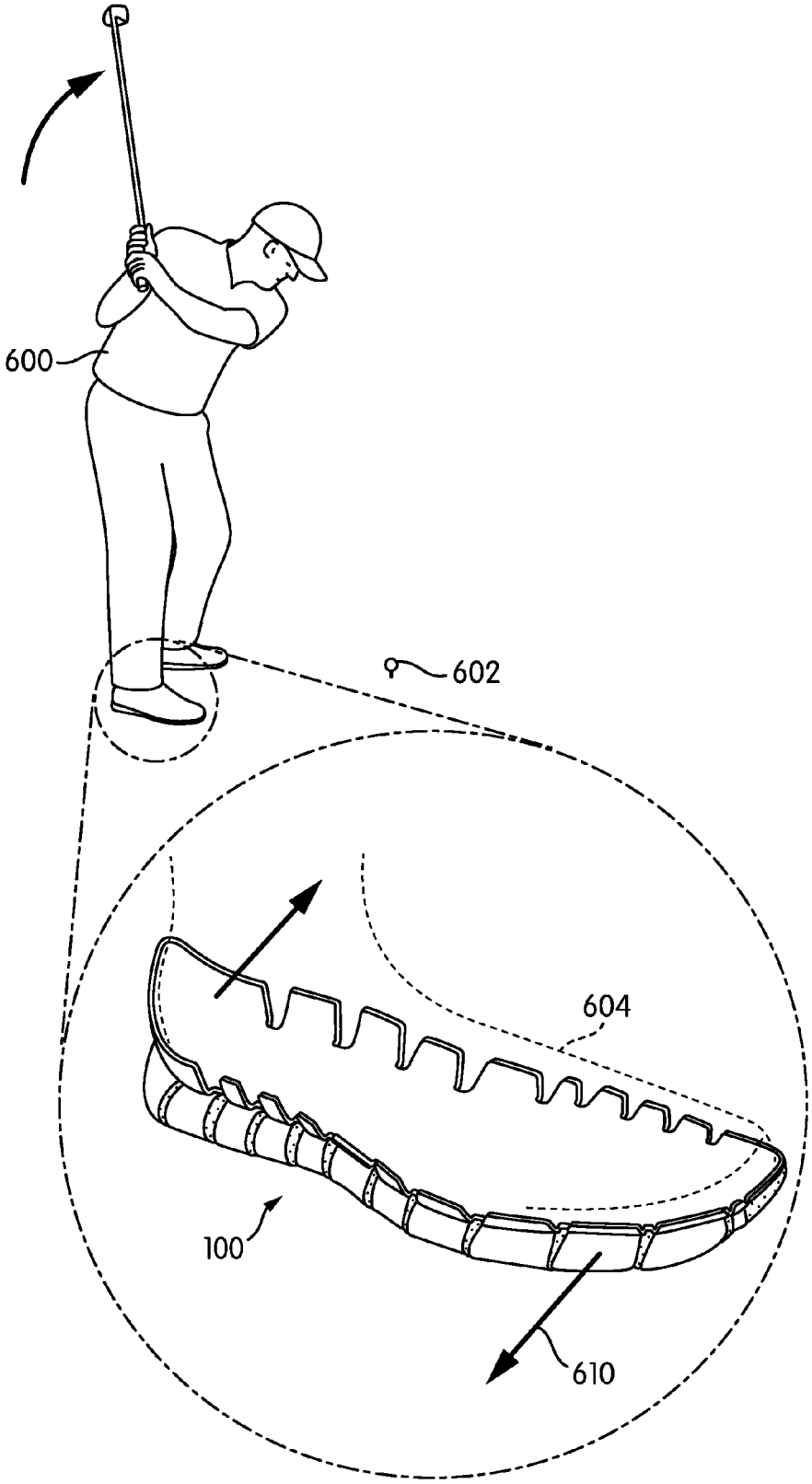
FIG. 14 is a schematic view of the sole structure of FIG. 13 as shear forces are applied during the golfer's backswing.
Figure 15:
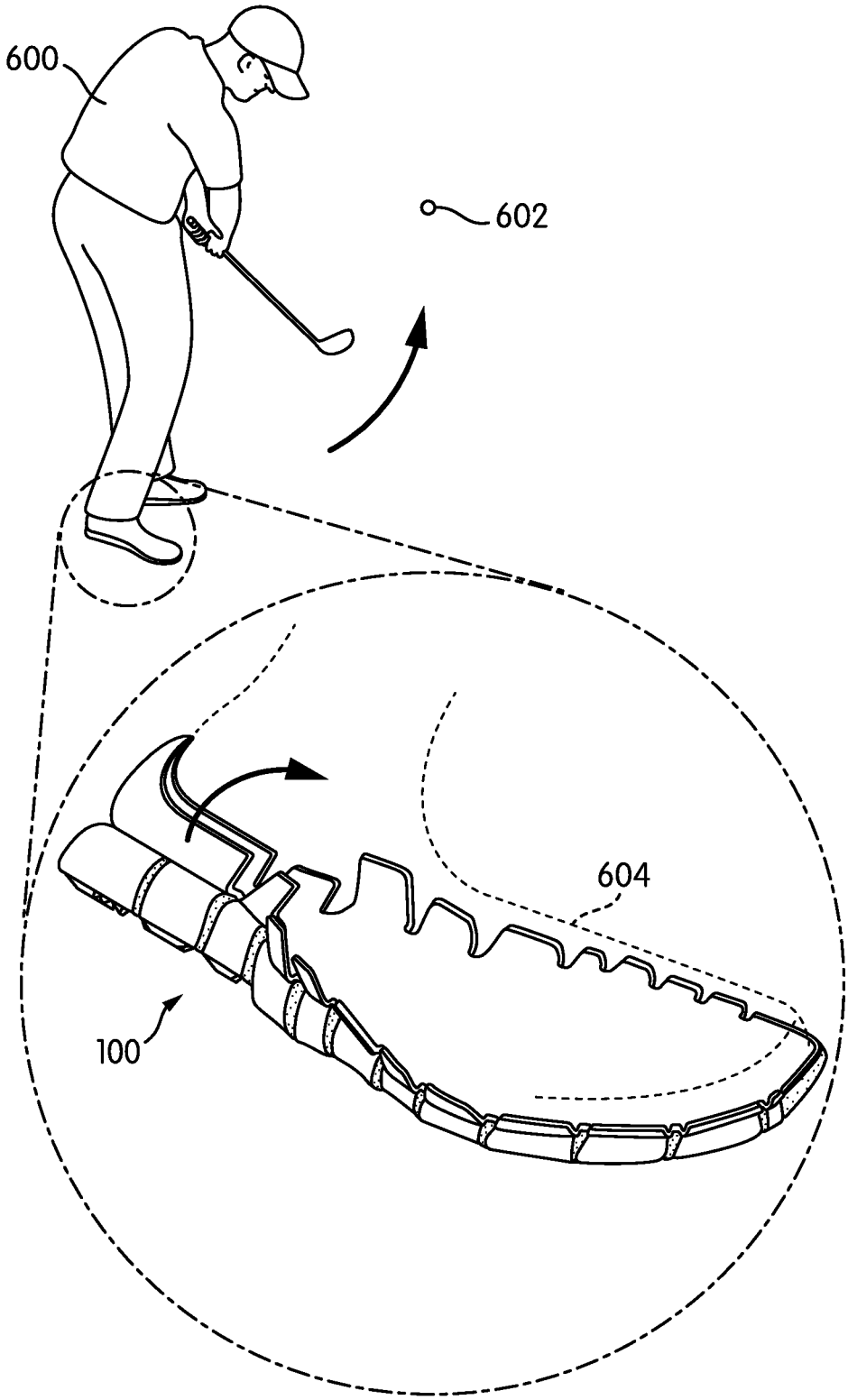
FIG. 15 is a schematic view of the sole structure of FIG. 13 twisting after the golfer makes contact with the ball.

FIGS. 13-15 illustrate various flexed and non-flexed configurations for a sole structure that may occur during different phases of a golf swing. In FIG. 13, a golfer 600 addresses ball 602. During the address, sole structure 100, which is worn on the rear foot 604, undergoes few stresses other than normal forces applied by the ground and foot. Next, in FIG. 14, as golfer 600 enters the backswing stage of his swing, shear forces 610 may be applied across sole structure 100 (generated by contact forces with the ground surface), in a generally lateral direction. As previously discussed, sole structure 100 is configured to resist or limit lateral bending, and therefore little to no visible deformation of sole structure 100 occurs. This ensures that the foot may stay supported within the periphery of sole structure 100 throughout the backswing.

Referring next to FIG. 15, during the acceleration stage and beginning of the follow through, the rear foot 604 may begin to twist such that the heel rotates while the forefoot remains planted in the ground surface. Thus, sole structure 100 undergoes torsion to accommodate this natural twisting motion of the foot in order to provide support throughout the follow through stage of the swing.

Figure 16:
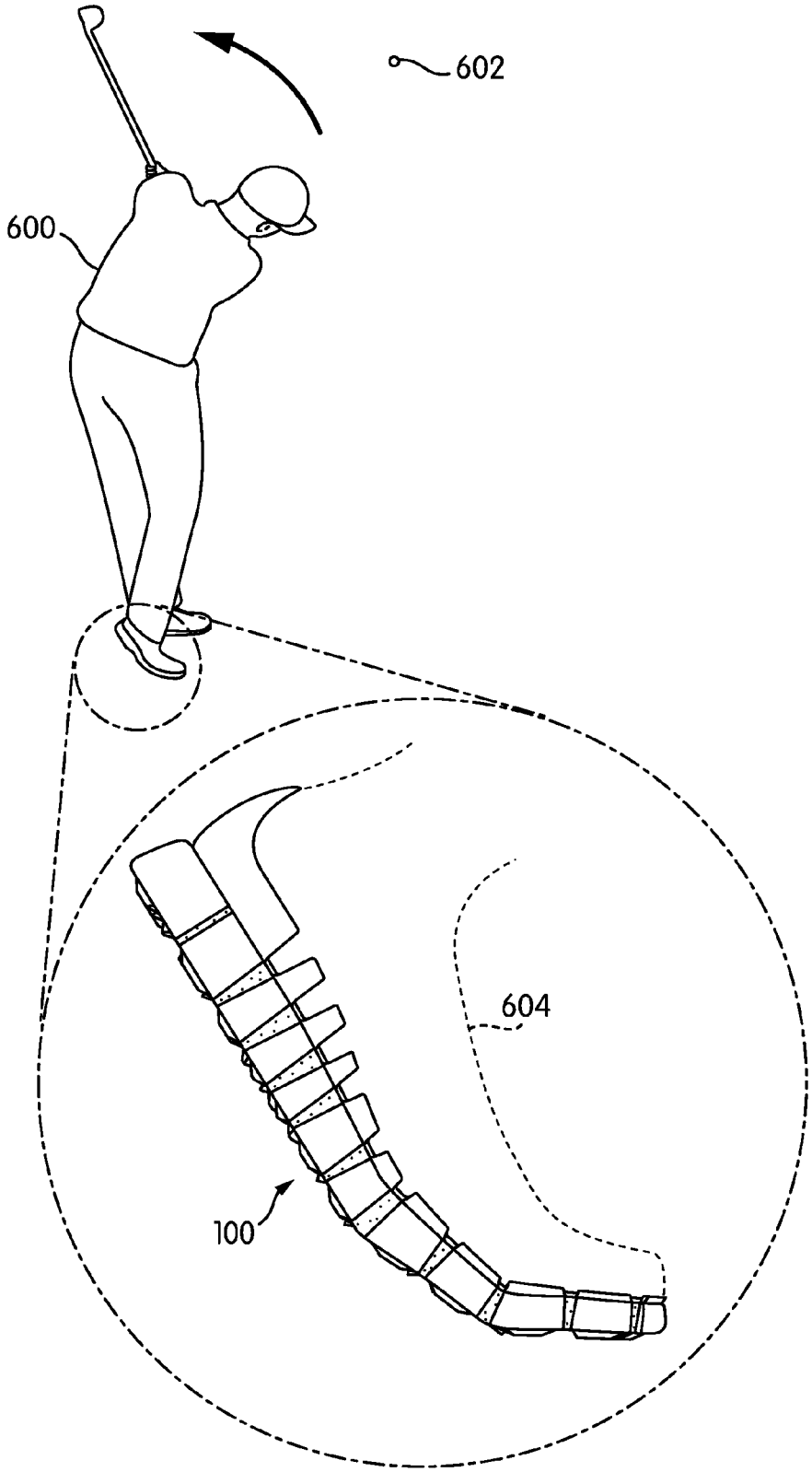

Finally, as seen in FIG. 16, the golfer has almost reached the final position of the swing. At this point, the rear foot has been fully rotated, with some vertical bending occurring as the forefoot continues to lift off the ground. In this case, sole structure 100 is able to accommodate the natural vertical bending motion of the foot to provide stability at the end of the follow through stage of the swing.

Figure 17:
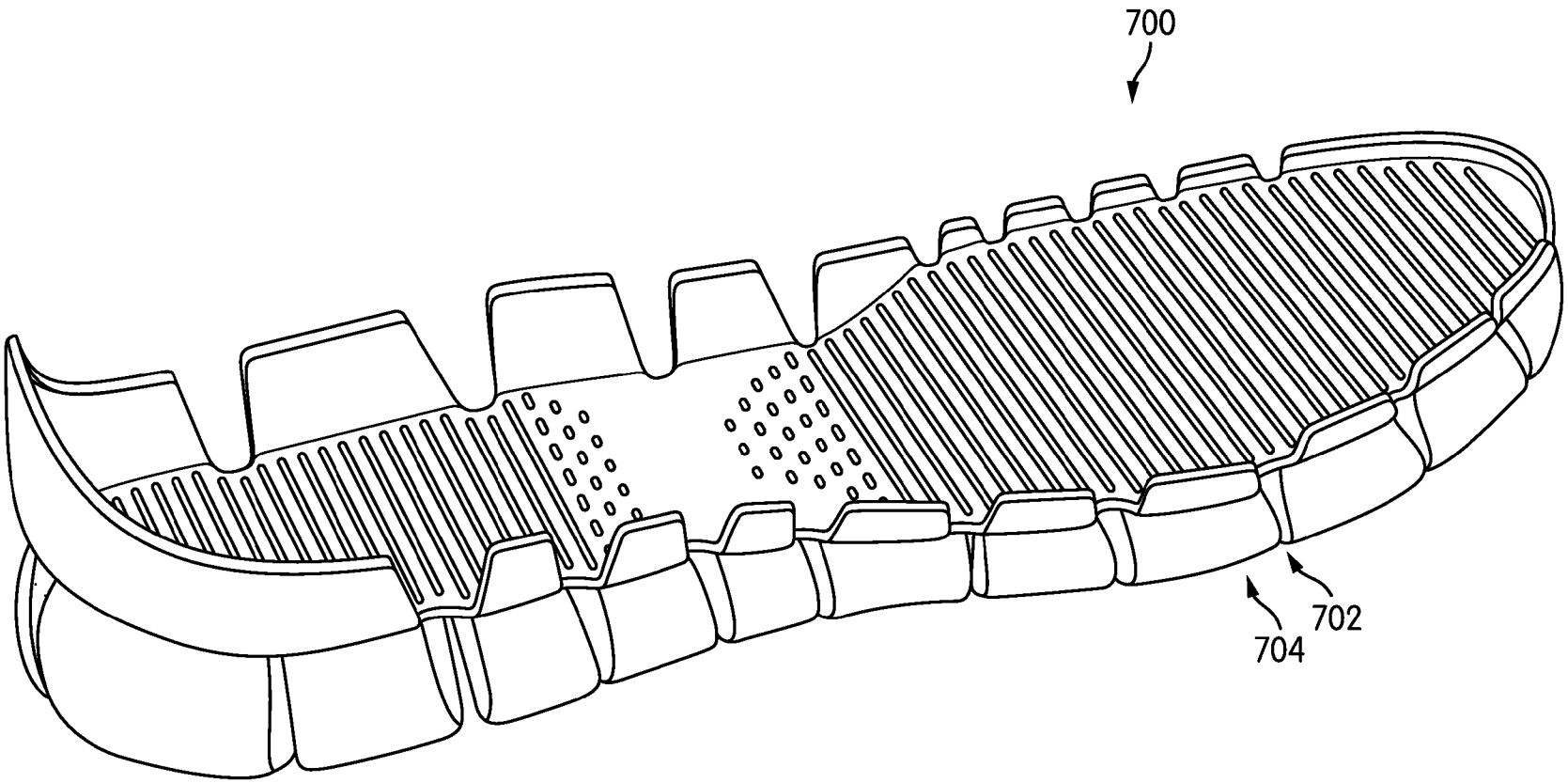
FIG. 17 is an isometric view of another embodiment of a sole structure.
Figure 18:
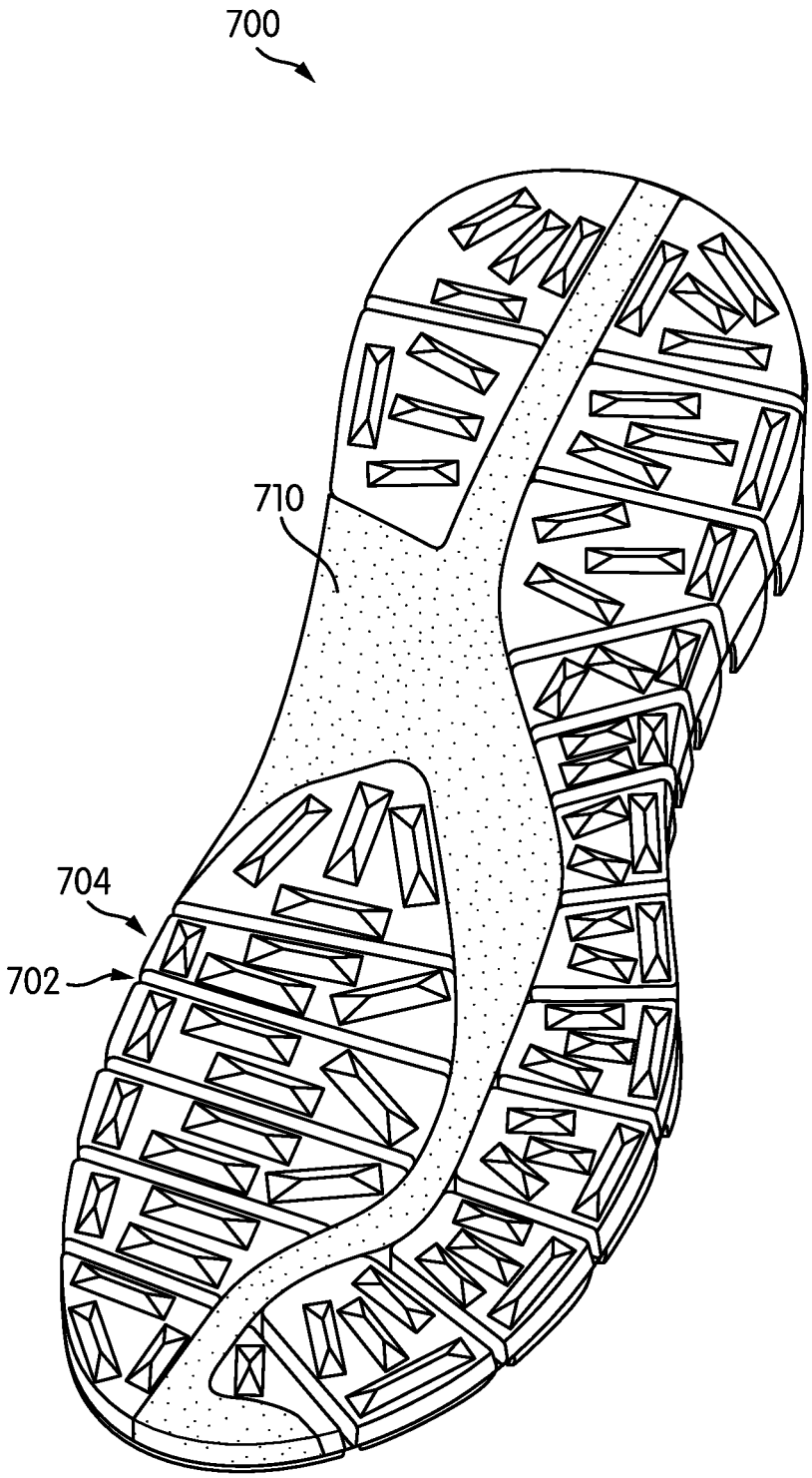
FIG. 18 is a bottom isometric view of the sole structure of FIG. 17.

It is contemplated that in an alternative embodiment, some flexing regions may comprise gaps that may not be filled with a compressible material. As one possible example, FIGS. 17 and 18 illustrate an isometric view and a bottom isometric view, respectively, of an embodiment of a sole structure 700. In this alternative embodiment, sole structure 700 may have a substantially similar configuration to the previous embodiments of sole structure 100 discussed above. However, in contrast to the previous embodiments, sole structure 700 may include a plurality of gaps 702 that separate adjacent segmented portions 704. More specifically, segmented portions 704 are separated along the center of sole structure 700 by a central compressible member 710, but adjacent segmented portions on the lateral and medial sides of sole structure 700 are separated by gaps, rather than a compressible material. In this embodiment, plurality of gaps 702 function as flexing regions between adjacent segmented portions 704 and may provide similar types of flexing to the flexing regions of the previous embodiments.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A sole structure for an article of footwear, comprising:

a plate member including a first side and a second side;

a plurality of segmented portions attached to the second side of the plate member, wherein the plurality of segmented portions are configured to contact a ground surface, and the plurality of segmented portions being separated by a plurality of outwardly extending flexing regions;

a central flexing region extending from a forefoot portion of the sole structure to a heel portion of the sole structure, the central flexing region being exposed along a forward edge of the sole structure, the central flexing region also being exposed along a rearward edge of the sole structure, the central flexing region separating the plurality of segmented portions into a first set of segmented portions and a second set of segmented portions, the first set of segmented portions having a greater number of segmented portions than the second set of segmented portions;

the central flexing region further including a medial arch region, the medial arch region separating a forefoot set of segmented portions from a heel set of segmented portions, the medial arch region extending to a midfoot edge of the sole structure, and the medial arch region being substantially wider than each of the plurality of outwardly extending flexing regions;

the plurality of segmented portions being further separated by a plurality of outwardly extending flexing regions, wherein the plurality of outwardly extending regions extend from the central flexing region to side edges of the sole structure; and wherein the plate member includes a plurality of side sections extending from an outer periphery of the plate member, the plurality of side sections presenting a sidewall portion.

2. The sole structure according to claim 1, wherein the plurality of side sections extend partially in a vertical direction, wherein the vertical direction is perpendicular to a longitudinal direction of the sole structure and wherein the vertical direction is perpendicular to a lateral direction of the sole structure.

3. The sole structure according to claim 1, wherein the plurality of side sections are spaced apart from one another.

4. The sole structure according to claim 3, wherein the plurality of side sections are approximately aligned with the plurality of segmented portions with respect to a longitudinal direction of the sole structure.

5. The sole structure according to claim 1, wherein the first set of segmented portions are spaced apart from the second set of segmented portions by a central longitudinal portion.

6. The sole structure according to claim 5, wherein the central longitudinal portion is more compressible than the plurality of segmented portions.

7. A sole structure for an article of footwear, comprising:

a plate member including a first side and a second side;

a plurality of segmented portions attached to the second side of the plate member, wherein the plurality of segmented portions are configured to contact a ground surface;

the plurality of segmented portions further comprising a first set of segmented portions that are located on a lateral side of the sole structure and a second set of segmented portions that are located on a medial side of the sole structure, wherein the first set of segmented portions comprises a greater number of segmented portions than the second set of segmented portions;

wherein the first set of segmented portions are spaced apart in the longitudinal direction and wherein the second set of segmented portions are spaced apart in the longitudinal direction;

wherein the first set of segmented portions are separated from the second set of segmented portions in the lateral direction by a central longitudinal portion, wherein the central longitudinal portion extends from a forward edge of the sole structure to a rearward edge of the sole structure, the central longitudinal portion being exposed along the forward edge, the central longitudinal portion also being exposed along the rearward edge;

the central longitudinal portion further including a medial arch region, the medial arch region separating a forefoot set of segmented portions from a heel set of segmented portions, the medial arch region extending to a midfoot edge of the sole structure;

wherein the plurality of segmented portions comprise a lower layer of the sole structure and wherein the plate member comprises an upper layer of the sole structure; and wherein a maximum cross-sectional thickness of the upper layer is less than a minimum cross-sectional thickness of the lower layer.

8. The sole structure according to claim 7, wherein the minimum cross-sectional thickness of the lower layer is at least two times greater than the maximum cross-sectional thickness of the upper layer.

9. The sole structure according to claim 8, wherein the minimum cross-sectional thickness of the lower layer is at least five times greater than the maximal cross-sectional thickness of the upper layer.

10. The sole structure according to claim 7, wherein the sole structure is configured to enhance vertical bending and torsion about a longitudinal axis.

11. The sole structure according to claim 10, wherein the sole structure is configured to resist lateral bending.

12. The sole structure according to claim 7, wherein the plate member includes a plurality of flex grooves.

13. The sole structure according to claim 12, wherein the width of the plurality of flex grooves is less than the width of the spacing between adjacent segmented portions.

14. The sole structure according to claim 1, wherein the plurality of outwardly extending flexing regions includes a first outwardly extending flexing region secured to a lower surface of the plate member and extending to a ground engaging surface;

the plurality of segmented portions including a first segmented portion and a second segmented portion;

the first outwardly extending flexing region being disposed between the first segmented portion and the second segmented portion so that the first outwardly extending flexing region divides the first segmented portion from the second segmented portion from the plate surface to the ground engaging surface.

15. The sole structure according to claim 3, wherein a gap between a first side section and a second side section aligns with a first outwardly extending flexing region along a side edge of the sole structure, such that the sole structure accommodates vertical bending along the gap and the first outwardly extending flexing region.

* * * * *